US012359853B2

(12) United States Patent
Satou et al.

(10) Patent No.: US 12,359,853 B2
(45) Date of Patent: Jul. 15, 2025

(54) HEAT EXCHANGER

(71) Applicant: DAIKIN INDUSTRIES, LTD., Osaka (JP)

(72) Inventors: Ken Satou, Osaka (JP); Tomohiko Sakamaki, Osaka (JP); Kengo Uchida, Osaka (JP); Yoshio Oritani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 498 days.

(21) Appl. No.: 17/744,022

(22) Filed: May 13, 2022

(65) Prior Publication Data

US 2022/0268497 A1 Aug. 25, 2022

Related U.S. Application Data

(63) Continuation of application No. PCT/JP2020/039090, filed on Oct. 16, 2020.

(30) Foreign Application Priority Data

Nov. 14, 2019 (JP) ..... 2019-205871

(51) Int. Cl.
*F25B 39/00* (2006.01)
*F25B 31/00* (2006.01)
(Continued)

(52) U.S. Cl.
CPC ..... *F25B 39/00* (2013.01); *F25B 41/42* (2021.01); *F28D 1/0535* (2013.01);
(Continued)

(58) Field of Classification Search
CPC ..... F25B 39/00; F25B 41/42; F25B 31/004; F28D 1/0535; F28F 9/0202; F28F 9/22
(Continued)

(56) References Cited

U.S. PATENT DOCUMENTS 9,033,029 B2 * 5/2015 Park ..... F28F 9/0273 165/151
11,236,954 B2 * 2/2022 Takafuji ..... F28D 1/05333
(Continued)

FOREIGN PATENT DOCUMENTS

JP 2005-513403 A 5/2005
JP 2008-528946 A 7/2008
(Continued)

OTHER PUBLICATIONS

Extended European search report issued in corresponding European Application No. 20887557.5 dated Nov. 25, 2022 (5 pages).
(Continued)

*Primary Examiner* — Claire E Rojohn, III
(74) *Attorney, Agent, or Firm* — Osha Bergman Watanabe & Burton LLP

(57) ABSTRACT

A heat exchanger includes: heat transfer tubes aligned in an up-down direction; a liquid header connected to ends of the heat transfer tubes; and connection tubes aligned in the up-down direction and connected to the liquid header. The heat transfer tubes include: a first heat transfer tube disposed at a lowermost position; and a second heat transfer tube disposed above and adjacent to the first heat transfer tube. The connection tubes include: a first connection tube disposed at a lowermost position; and a second connection tube disposed above the first connection tube. The liquid header includes: a first flow path connected to the first connection tube and the first heat transfer tube; and a second flow path connected to the second connection tube and the second heat transfer tube.

8 Claims, 16 Drawing Sheets

(51) Int. Cl.

| | |
|---|---|
| ***F25B 41/42*** | (2021.01) |
| ***F28D 1/053*** | (2006.01) |
| ***F28F 9/02*** | (2006.01) |
| ***F28F 9/22*** | (2006.01) |

(52) U.S. Cl.
CPC ..... *F28F 9/0202* (2013.01); *F28F 9/22* (2013.01); *F25B 31/004* (2013.01)

(58) Field of Classification Search
USPC ..... 62/324.6; 165/153, 174
See application file for complete search history.

(56) References Cited

U.S. PATENT DOCUMENTS

| | | | | |
|---|---|---|---|---|
| 11,421,947 | B2 * | 8/2022 | Matsui | F25B 39/04 |
| 11,506,434 | B2 * | 11/2022 | Mislak | F25B 39/00 |
| 2005/0006073 | A1 * | 1/2005 | Demuth | F28D 1/05391 165/150 |
| 2005/0039901 | A1 * | 2/2005 | Demuth | F28F 9/0278 165/173 |
| 2005/0103486 | A1 * | 5/2005 | Demuth | F28F 9/0221 165/174 |
| 2008/0296005 | A1 | 12/2008 | Taras et al. | |
| 2009/0126920 | A1 | 5/2009 | Demuth et al. | |
| 2015/0101363 | A1 * | 4/2015 | Matsuda | F25B 39/04 165/174 |
| 2015/0241131 | A1 * | 8/2015 | Katoh | F28D 1/05366 165/140 |
| 2016/0169596 | A1 * | 6/2016 | Jindou | F25B 39/00 62/526 |
| 2016/0223231 | A1 * | 8/2016 | Morimoto | F28F 1/022 |
| 2017/0082332 | A1 * | 3/2017 | Onaka | F25B 1/00 |
| 2017/0241684 | A1 * | 8/2017 | Ito | F28F 9/0275 |
| 2017/0328652 | A1 * | 11/2017 | Matsui | F28F 9/0268 |
| 2018/0156512 | A1 * | 6/2018 | Mislak | F28F 9/0265 |
| 2019/0093965 | A1 * | 3/2019 | Higashiiue | F28D 1/0435 |
| 2020/0200476 | A1 | 6/2020 | Satou et al. | |
| 2021/0003353 | A1 * | 1/2021 | Akaiwa | F25B 41/00 |
| 2022/0120481 | A1 * | 4/2022 | Hirokawa | F25B 41/42 |

FOREIGN PATENT DOCUMENTS

| | | | | |
|---|---|---|---|---|
| JP | 2009-41797 | A | | 2/2009 |
| JP | 2010-112580 | A | | 5/2010 |
| JP | 2015-055412 | A | | 3/2015 |
| JP | 2018048766 | A | * | 3/2018 |
| JP | 2018-138826 | A | | 9/2018 |
| JP | 2019-11941 | A | | 1/2019 |
| WO | 2015/178097 | A1 | | 11/2015 |

OTHER PUBLICATIONS

International Search Report issued in corresponding International Application No. PCT/JP2020/039090 mailed Nov. 10, 2020 (3 pages).

International Preliminary Report on Patentability issued in corresponding International Application No. PCT/JP2020/039090 mailed May 17, 2022 (5 pages).

* cited by examiner

HEAT EXCHANGER

TECHNICAL FIELD

The present disclosure relates to a heat exchanger.

BACKGROUND

Patent Literature 1 discloses an air conditioner including an outdoor heat exchanger that causes heat exchange between a refrigerant and outdoor air. The outdoor heat exchanger includes a plurality of flat tubes (heat transfer tubes) aligned in an up-down direction, a first header connected to one longitudinal end of each of the plurality of flat tubes, and a second header connected to the other longitudinal end of each of the plurality of flat tubes. An interior of the first header and an interior of the second header are partitioned into a plurality of rooms by a plurality of partition plates.

In the air conditioner disclosed in Patent Literature 1, when the outdoor heat exchanger is used as an evaporator for heating operation, an uppermost room of the first header is an outlet chamber that serves as a refrigerant outlet, and a lowermost room of the second header is an inlet chamber that serves as a refrigerant inlet. The refrigerant that has flowed into the inlet chamber flows through the flat tube provided between the first header and the second header and the chambers provided in the first header and the second header, and is discharged from the outlet chamber to outside of the outdoor heat exchanger in an evaporated state. The plurality of flat tubes are connected to the inlet chamber of the second header, and the refrigerant that has flowed into the inlet chamber is divided into the plurality of flat tubes.

CITATION LIST

Patent Literature

PATENT LITERATURE 1: Japanese Laid-Open Patent Publication No. 2010-112580

SUMMARY

A heat exchanger according to one or more embodiments of the present disclosure includes a plurality of heat transfer tubes aligned in an up-down direction, a liquid header to which ends of the plurality of heat transfer tubes are connected, and a plurality of connection tubes aligned in the up-down direction and connected to the liquid header, in which the plurality of heat transfer tubes include a first heat transfer tube disposed at a lowermost position and a second heat transfer tube disposed above and adjacent to the first heat transfer tube, the plurality of connection tubes include a first connection tube disposed at a lowermost position and a second connection tube disposed above the first connection tube, and the liquid header includes a first flow path to which the first connection tube and the first heat transfer tube are connected, and a second flow path to which the second connection tube and the second heat transfer tube are connected.

DETAILED DESCRIPTION

Figure 1:
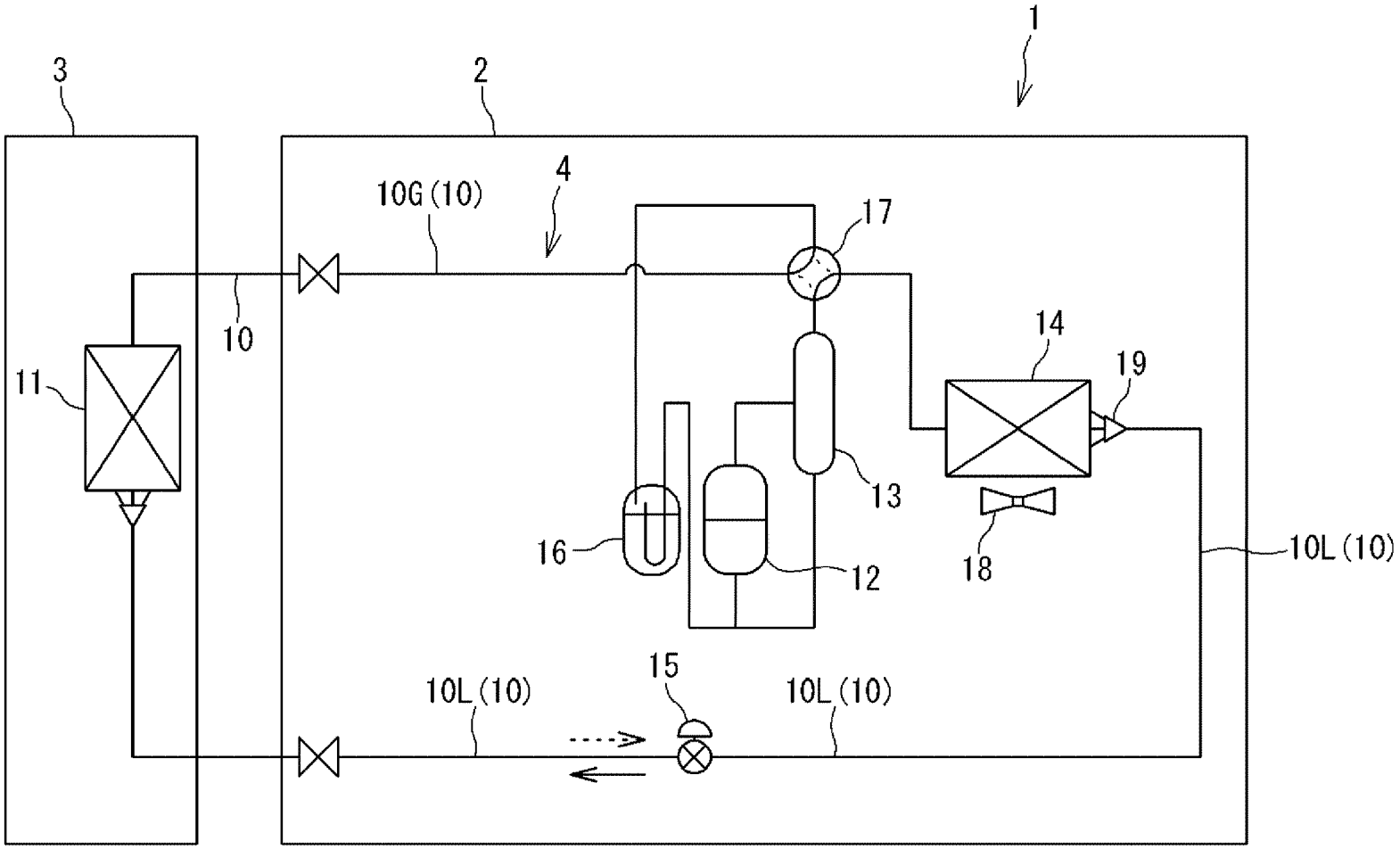
FIG. 1 is a schematic configuration diagram of an air conditioner according to one or more embodiments of the present disclosure.

FIG. 1 is a schematic configuration diagram of an air conditioner according to one or more embodiments of the present disclosure.

An air conditioner 1 as a refrigeration apparatus includes an outdoor unit 2 installed outdoors and an indoor unit 3 installed indoors. The outdoor unit 2 and the indoor unit 3 are connected to each other by a connection pipe. The air conditioner 1 includes a refrigerant circuit 4 that performs vapor compression refrigeration cycle operation. The refrigerant circuit 4 is provided with an indoor heat exchanger 11, a compressor 12, an oil separator 13, an outdoor heat exchanger 14, an expansion valve (expansion mechanism) 15, an accumulator 16, a four-way switching valve 17, and the like, which are connected by a refrigerant pipe 10. The refrigerant pipe 10 includes a liquid pipe 10L and a gas pipe 10G.

The indoor heat exchanger 11 allows a refrigerant to exchange heat with indoor air, and is provided in the indoor unit 3. Examples of the indoor heat exchanger 11 include a cross-fin fin-and-tube heat exchanger and a microchannel heat exchanger. The indoor heat exchanger 11 is provided therearound with an indoor fan (not shown) that sends the indoor air to the indoor heat exchanger 11.

The compressor 12, the oil separator 13, the outdoor heat exchanger 14, the expansion valve 15, the accumulator 16, and the four-way switching valve 17 are provided in the outdoor unit 2.

The compressor 12 compresses a refrigerant sucked from a suction port and discharge the compressed refrigerant from a discharge port. Examples of the compressor 12 include various compressors such as a scroll compressor.

The oil separator 13 is configured to separate lubricant from fluid mixture that contains the lubricant and a refrigerant and is discharged from the compressor 12. The refrigerant thus separated is sent to the four-way switching valve 17 whereas the lubricant is returned to the compressor 12.

The outdoor heat exchanger 14 is configured to allow the refrigerant to exchange heat with outdoor air. The outdoor heat exchanger 14 according to one or more embodiments is a microchannel heat exchanger. The outdoor heat exchanger 14 is provided therearound with an outdoor fan 18 that sends the outdoor air to the outdoor heat exchanger 14. The outdoor heat exchanger 14 has a liquid side end connected with a flow divider 19 including a capillary tube.

The expansion valve 15 is disposed between the outdoor heat exchanger 14 and the indoor heat exchanger 11 in the refrigerant circuit 4, and expands an inflow refrigerant to be decompressed to a predetermined pressure. Examples of the expansion valve 15 include an electronic expansion valve 15 having a variable opening degree.

The accumulator 16 separates the inflow refrigerant into a gas refrigerant and a liquid refrigerant, and is disposed between the suction port of the compressor 12 and the four-way switching valve 17 in the refrigerant circuit 4. The gas refrigerant thus separated at the accumulator 16 is sucked into the compressor 12.

The four-way switching valve 17 is switchable between a first state indicated by solid lines in FIG. 1 and a second state indicated by broken lines. The four-way switching valve 17 is switched into the first state while the air conditioner 1 executes cooling operation, and the four-way switching valve 17 is switched into the second state while the air conditioner 1 executes heating operation.

When the air conditioner 1 executes cooling operation, the outdoor heat exchanger 14 functions as a refrigerant condenser (radiator) and the indoor heat exchanger 11 functions as a refrigerant evaporator. A gas refrigerant discharged from the compressor 12 condenses at the outdoor heat exchanger 14, is then decompressed at the expansion valve 15, and evaporates at the indoor heat exchanger 11 to be sucked into the compressor 12. During defrosting operation of removing frost adhering to the outdoor heat exchanger 14 due to heating operation, as in cooling operation, the outdoor heat exchanger 14 functions as a refrigerant condenser and the indoor heat exchanger 11 functions as a refrigerant evaporator.

When the air conditioner 1 executes heating operation, the outdoor heat exchanger 14 functions as a refrigerant evaporator and the indoor heat exchanger 11 functions as a refrigerant condenser. A gas refrigerant discharged from the compressor 12 condenses at the indoor heat exchanger 11, is then decompressed at the expansion valve 15, and evaporates at the outdoor heat exchanger 14 to be sucked into the compressor 12.

[Configuration of Outdoor Heat Exchanger]

Figure 2:
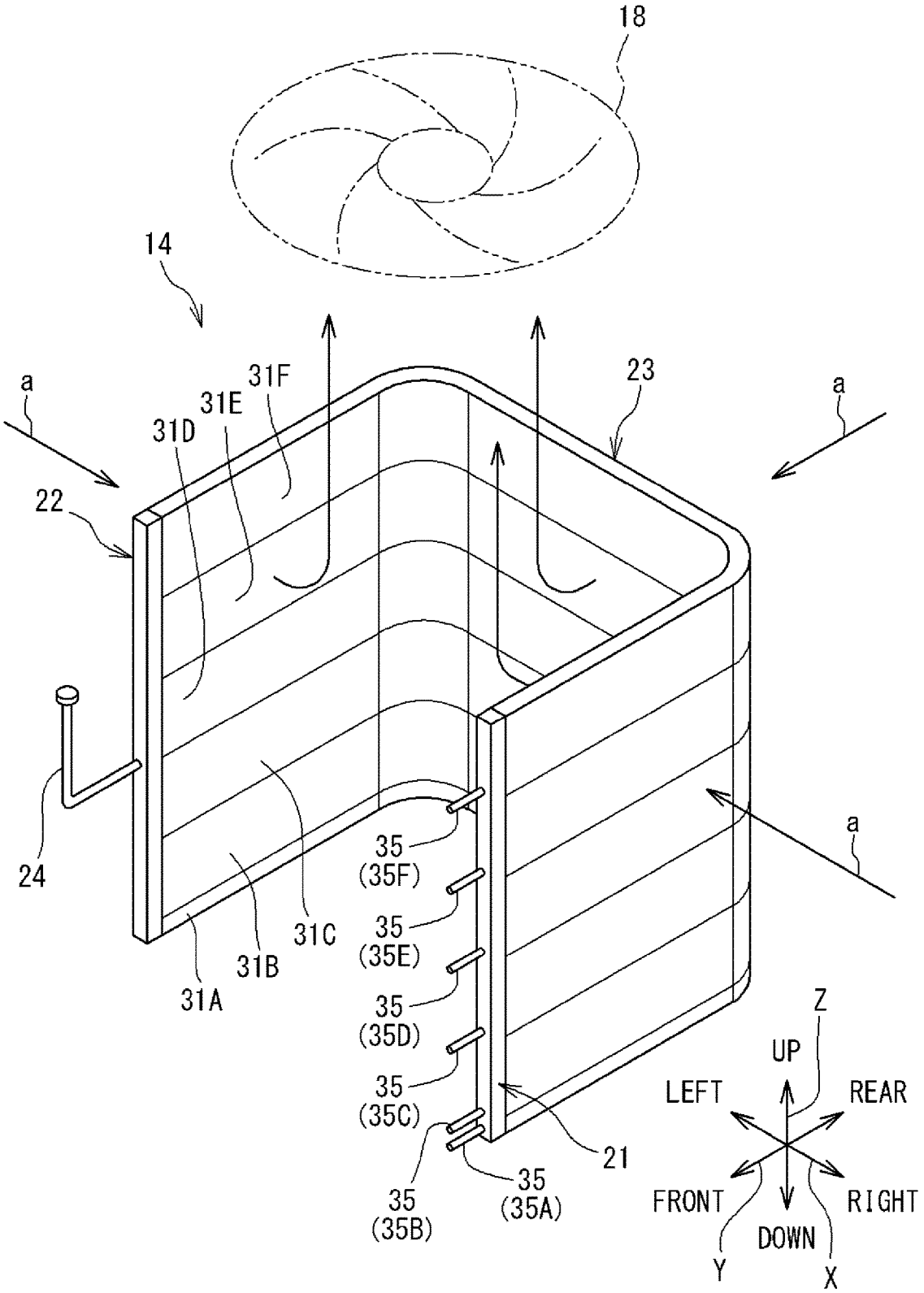
FIG. 2 is a perspective view of an outdoor heat exchanger of the air conditioner.
Figure 3:
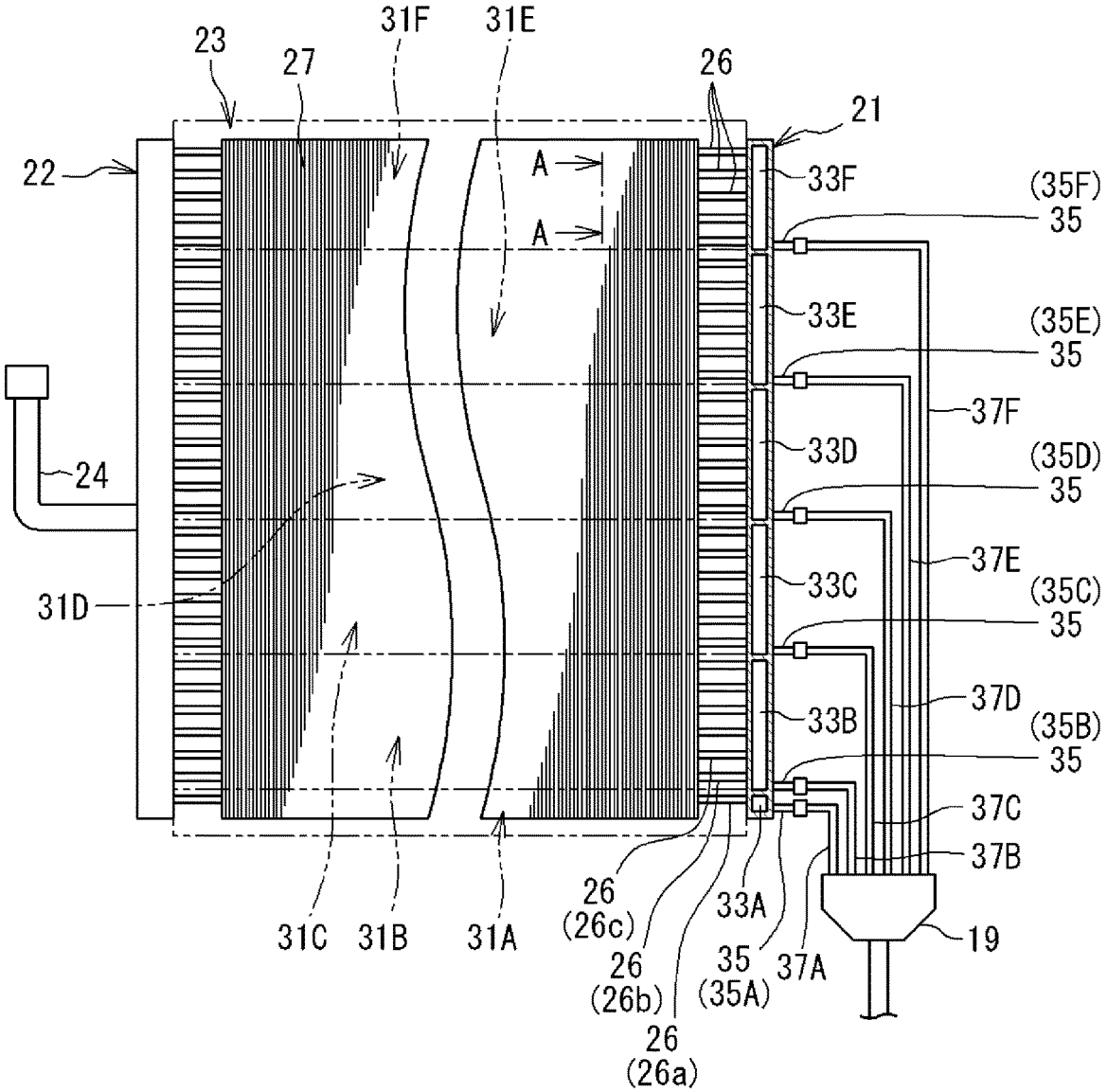
FIG. 3 is a schematic developed view of the outdoor heat exchanger.
Figure 4:
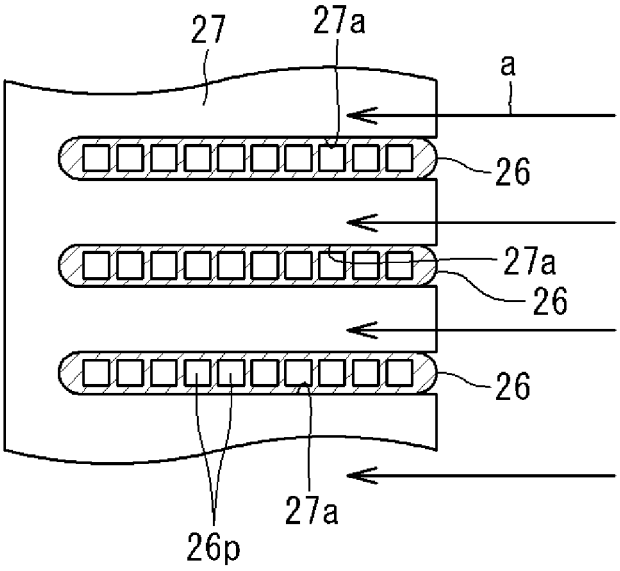
FIG. 4 is a sectional view taken along arrow A-A indicated in FIG. 3.

FIG. 2 is a perspective view of the outdoor heat exchanger of the air conditioner. FIG. 3 is a schematic developed view of the outdoor heat exchanger. FIG. 4 is a sectional view taken along arrow A-A indicated in FIG. 3.

The following description may include expressions such as "up", "down", "left", "right", "front (front surface)", and "rear (behind)", for indication of directions and positions. These expressions follow directions of arrows included in FIG. 2, unless otherwise specified. Specifically, the following description assumes that a direction indicated by arrow X in FIG. 2 is a left-right direction, a direction indicated by arrow Y is a front-rear direction, and a direction indicated by arrow Z is an up-down direction. These expressions describing the directions and the positions are adopted for convenience of description, and do not limit, unless otherwise specified, directions or positions of the entire outdoor heat exchanger 14 and various constituents of the outdoor heat exchanger 14 to the directions or the positions described herein.

The outdoor heat exchanger 14 causes heat exchange between the refrigerant flowing inside and air. The outdoor heat exchanger 14 according to one or more embodiments has a substantially U shape in a top view. The outdoor heat exchanger 14 is accommodated in, for example, a casing of the outdoor unit 2 having a rectangular parallelepiped shape, and is disposed to face three side walls of the casing. The outdoor heat exchanger 14 according to one or more embodiments includes a pair of headers 21 and 22 and a heat exchanger body 23. The pair of headers 21 and 22 and the heat exchanger body 23 include aluminum or an aluminum alloy.

The pair of headers 21 and 22 are disposed at both ends of the heat exchanger body 23. The header 21 is a liquid header that allows a liquid refrigerant (gas-liquid two-phase refrigerant) to flow therein. The header 22 is a gas header that allows a gas refrigerant to flow therein. The liquid header 21 and the gas header 22 are disposed to have a longitudinal direction aligned to the up-down direction Z. The flow divider 19 including capillary tubes 37A to 37F is connected to the liquid header 21. The gas header 22 is connected with a gas pipe 24.

The heat exchanger body 23 causes heat exchange between the refrigerant flowing inside and air. As indicated by arrow a, the air passes in a direction intersecting the heat exchanger body 23 from outside to inside of the heat exchanger body 23 having a substantially U shape.

As shown in FIG. 3, the heat exchanger body 23 includes a plurality of heat transfer tubes 26 and a plurality of fins 27. The heat transfer tubes 26 are disposed horizontally. The plurality of heat transfer tubes 26 are aligned in the up-down direction. Each of the heat transfer tubes 26 has one longitudinal end connected to the liquid header 21. Each of the heat transfer tubes 26 has the other longitudinal end connected to the gas header 22.

As shown in FIG. 4, each of the heat transfer tubes 26 according to one or more embodiments is a multi-hole tube provided with a plurality of holes 26*p* serving as a refrigerant flow path. Each of the holes 26*p* extends along the longitudinal direction of the heat transfer tube 26. The refrigerant exchanges heat with air while flowing through each hole 26*p* of the heat transfer tube 26. The plurality of holes 26*p* are aligned in a row in a direction orthogonal to the longitudinal direction of the heat transfer tube 26. The plurality of holes 26*p* are aligned along an airflow direction a in the heat exchanger body 23. The air passes between the plurality of heat transfer tubes 26 in the up-down direction. Each of the heat transfer tubes 26 has a flat shape in which a length in the up-down direction is smaller than a length in the airflow direction a.

The plurality of fins 27 are aligned along the longitudinal direction of the heat transfer tubes 26. Each of the fins 27 is a thin plate material that is long in the up-down direction. In each fin 27, a plurality of grooves 27*a* extending from one side to the other side in the airflow direction a are aligned at intervals in the up-down direction. The heat transfer tubes 26 are attached to the fins 27 while being inserted into the grooves 27*a* of the fins 27.

As shown in FIG. 2, the outdoor heat exchanger 14 according to one or more embodiments includes a row of heat exchanger body 23. The refrigerant unidirectionally flows from the liquid header 21 to the gas header 22 through the heat exchanger body 23, or unidirectionally flows from the gas header 22 to the liquid header 21 through the heat exchanger body 23.

The heat exchanger body 23 exemplarily depicted in FIG. 2 and FIG. 3 includes a plurality of heat exchange units 31A to 31F. The plurality of heat exchange units 31A to 31F are aligned in the up-down direction. The liquid header 21 has an interior partitioned in the up-down direction respectively for the heat exchange units 31A to 31F. In other words, as shown in FIG. 3, the interior of the liquid header 21 is provided with flow paths 33A to 33F respectively for the heat exchange units 31A to 31F.

The liquid header 21 is connected with a plurality of connection tubes 35A to 35F. The connection tubes 35A to 35F are provided corresponding to the flow paths 33A to 33F. The connection tubes 35A to 35F are connected with the capillary tubes 37A to 37F of the flow divider 19.

During heating operation, a liquid refrigerant obtained through dividing by the flow divider 19 flows through the capillary tubes 37A to 37F and the connection tubes 35A to 35F, flows into the flow paths 33A to 33F in the liquid header 21, and flows through one or some of the heat transfer tubes 26 connected to the flow paths 33A to 33F to reach the gas header 22. In contrast, during cooling operation or defrosting operation, the refrigerant divided into the heat transfer tubes 26 at the gas header 22 flows into the flow paths 33A to 33F of the liquid header 21, and flows from the flow paths 33A to 33F to the capillary tubes 37A to 37F to join at the flow divider 19.

In one or more embodiments, the capillary tubes 37A to 37F of the flow divider 19 corresponding to the heat exchange units 31A to 31F at upper positions are set to have a lower refrigerant flow resistance. This is because, as shown in FIG. 2, air is sent to the outdoor heat exchanger 14 by the outdoor fan 18 disposed above the outdoor heat exchanger 14, and the air and the refrigerant exchange heat with each other more efficiently in the heat exchange units 31A to 31F at the upper positions.

The gas header 22 has an interior not partitioned but is continuous over all the heat exchange units 31A to 31F. The refrigerant flowing from one gas pipe 24 into the gas header 22 is accordingly divided into all the heat transfer tubes 26, and the refrigerant flowing from all the heat transfer tubes 26 into the gas header 22 is joined at the gas header 22 to flow into the one gas pipe 24.

As shown in FIG. 3, in one or more embodiments, a first flow path 33A that connects a first heat transfer tube 26*a* at a lowermost position and the first connection tube 35A at a lowermost position to each other is provided at a lowermost part of the liquid header 21. The second flow path 33B connecting the second heat transfer tube 26*b* at a second lowermost position and the second connection tube 35B at a second lowermost position to each other is provided above the first flow path 33A of the liquid header 21. The second flow path 33B of the liquid header 21 connects not only the second heat transfer tube 26*b* but also the third heat transfer tube 26*c* at a third lowermost position, several heat transfer tubes 26 above the third heat transfer tube 26*c*, and the second connection tube 35B.

The refrigerant flowing from the first connection tube 35A into the liquid header 21 flows only through the first heat transfer tube 26*a* via the first flow path 33A and flows into the gas header 22. Therefore, the first heat exchange unit 31A at a lowermost position is configured only by the first heat transfer tube 26*a* at the lowermost position.

The refrigerant flowing from the second connection tube 35B into the liquid header 21 flows through the plurality of heat transfer tubes 26 including the second heat transfer tube 26*b* and the third heat transfer tube 26*c* via the second flow path 33B and flows into the gas header 22. Therefore, the second heat exchange unit 31B at a second lowermost position is configured by the plurality of heat transfer tubes 26 including the second heat transfer tubes 26*b* and the third heat transfer tubes 26*c*.

In the liquid header 21 shown in FIG. 3, the third flow path 33C, the fourth flow path 33D, the fifth flow path 33E, and the sixth flow path 33F are provided in that order from a bottom above the second flow path 33B. The liquid header 21 is provided with the third connection tube 35C, the fourth connection tube 35D, the fifth connection tube 35E, and the sixth connection tube 35F connected to the third to sixth flow paths 33C to 33F, respectively. The plurality of heat transfer tubes 26 are connected to the third to sixth flow paths 33C to 33F, respectively. Therefore, each of the third heat exchange unit 31C, the fourth heat exchange unit 31D, the fifth heat exchange unit 31E, and the sixth heat exchange unit 31F disposed above the second heat exchange unit 31B includes the plurality of heat transfer tubes 26.

[Specific Configuration of Liquid Header]

Hereinafter, a specific configuration of the liquid header 21 will be described.

Figure 5:
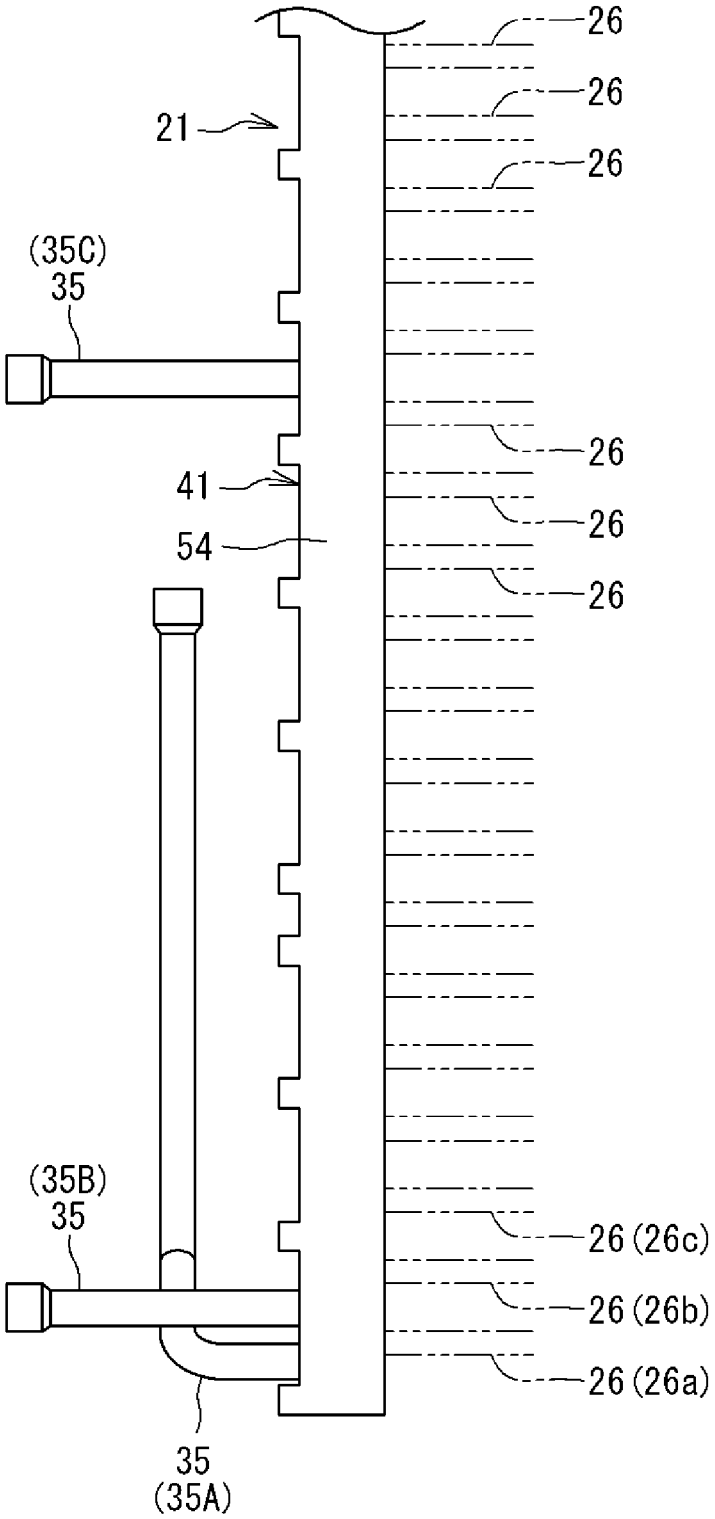
FIG. 5 is a side view of a lower part of a liquid header of the outdoor heat exchanger.
Figure 6:
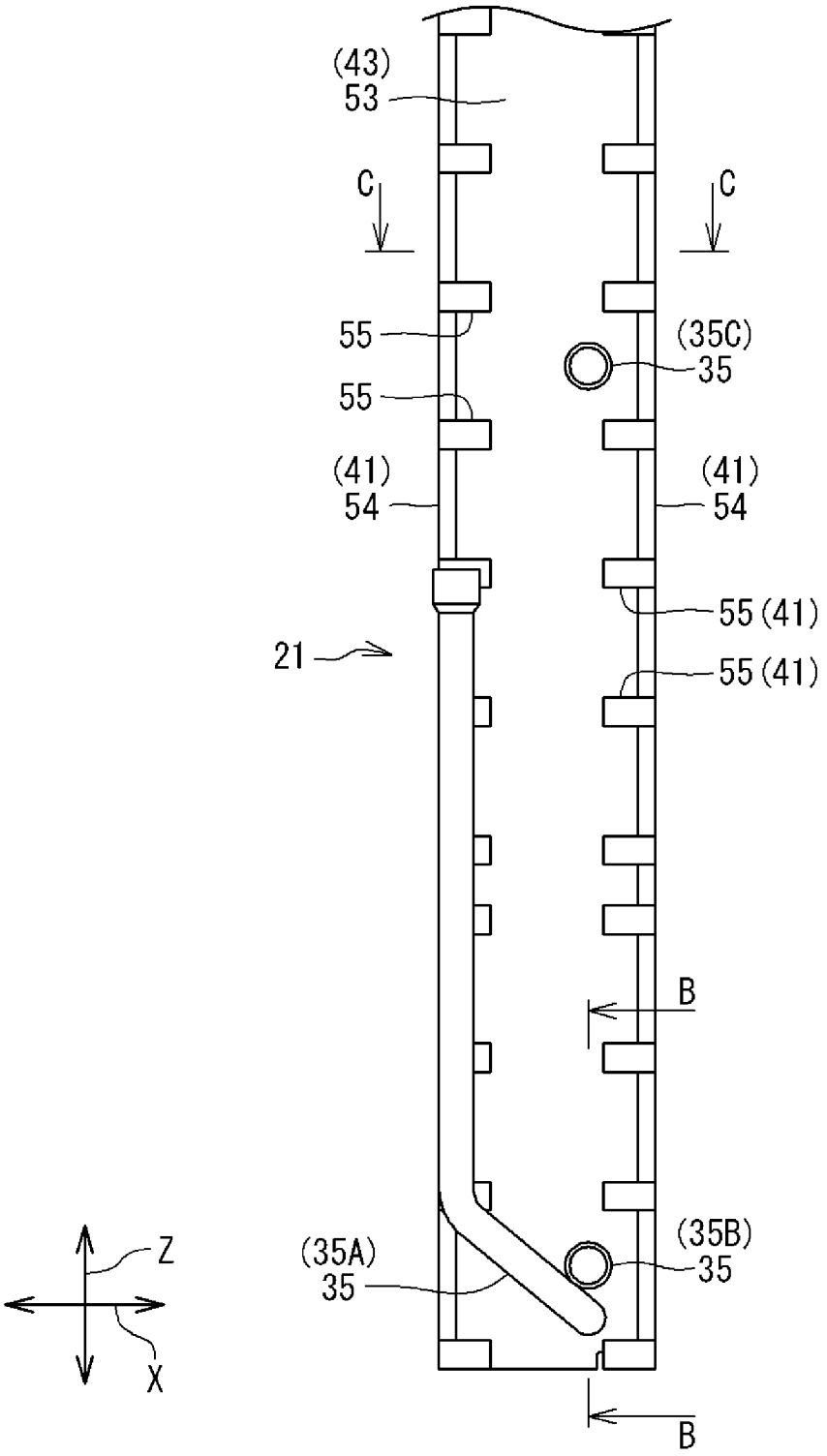
FIG. 6 is a front view of a lower part of the liquid header of the outdoor heat exchanger.
Figure 7:
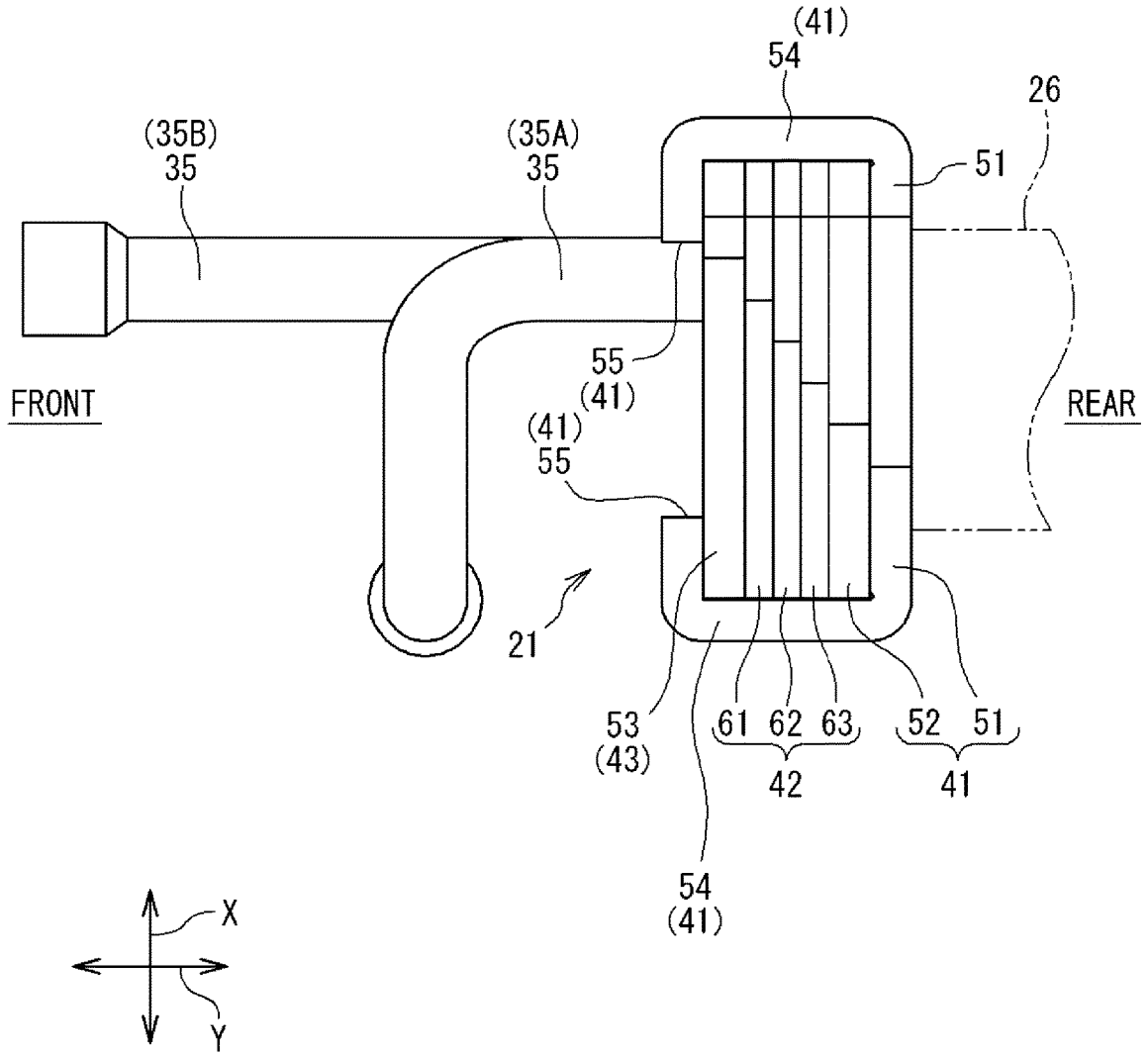
FIG. 7 is a bottom view of the liquid header of the outdoor heat exchanger.
Figure 8:
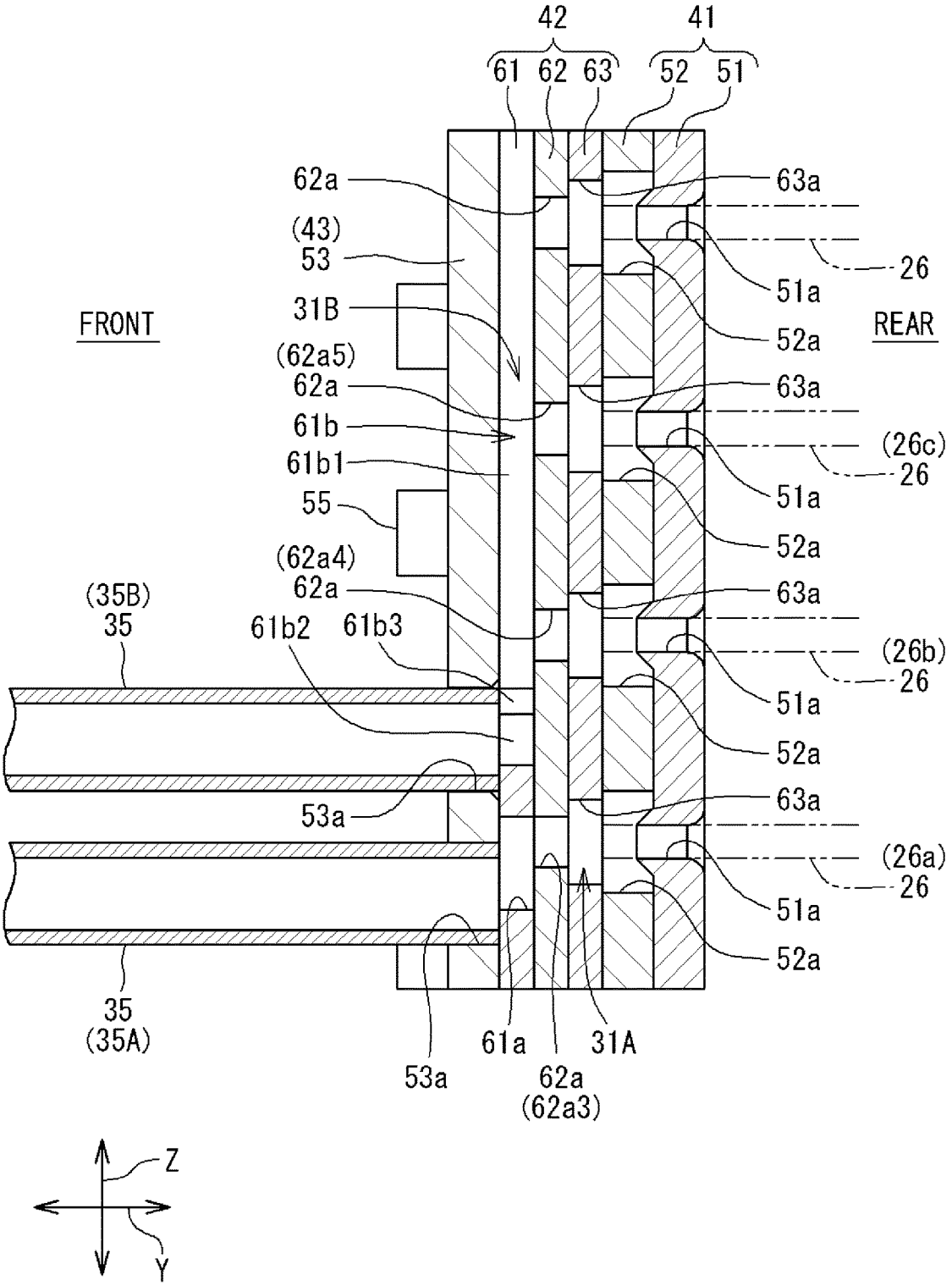
FIG. 8 is a sectional view taken along arrow B-B indicated in FIG. 6.
Figure 9:
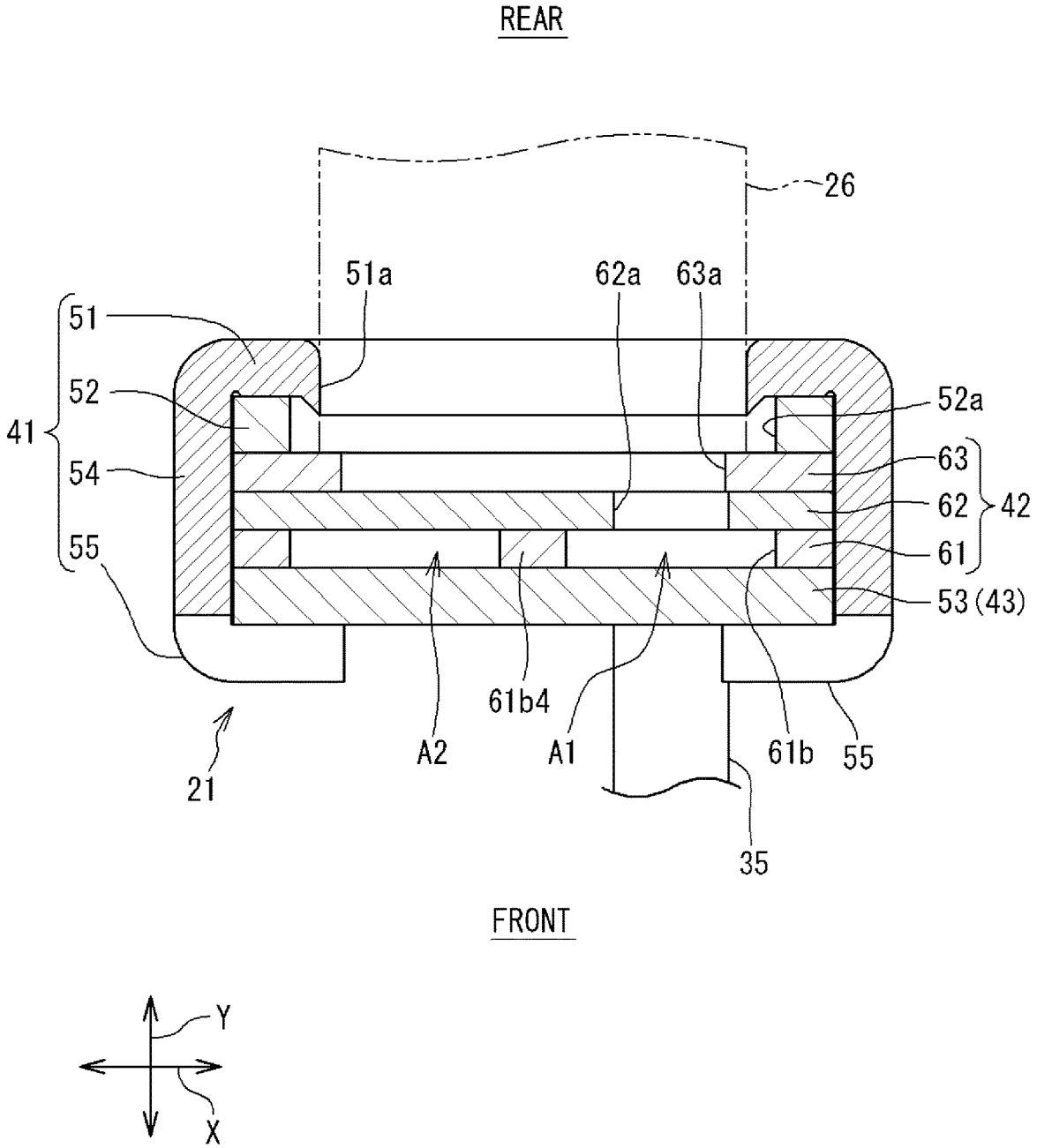
FIG. 9 is a sectional view taken along arrow C-C indicated in FIG. 6.
Figure 10:
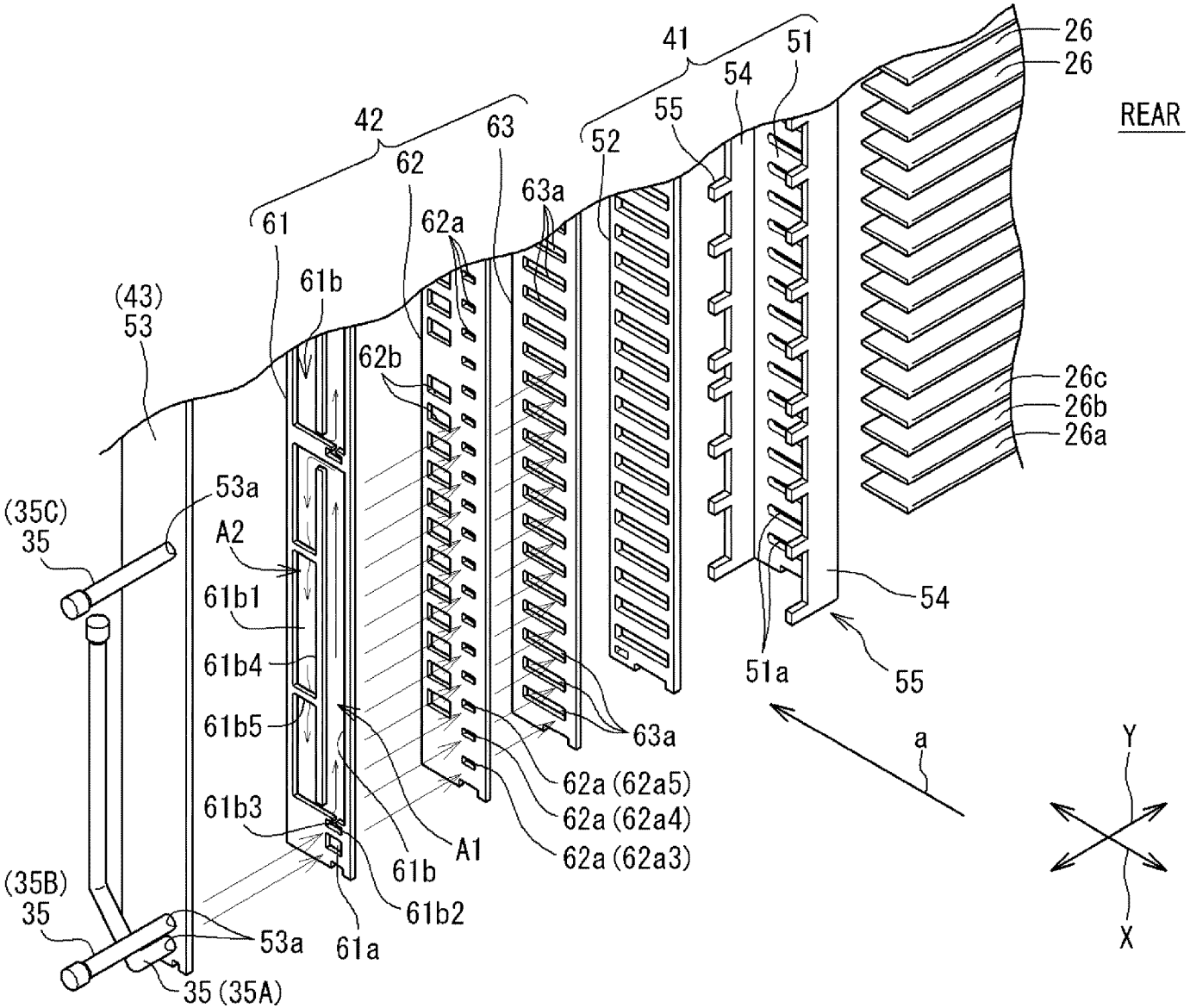
FIG. 10 is an exploded perspective view of the liquid header of the outdoor heat exchanger.

FIG. 5 is a side view of a lower part of the liquid header. FIG. 6 is a front view of the lower part of the liquid header. FIG. 7 is a bottom view of the liquid header. FIG. 8 is a sectional view taken along arrow B-B indicated in FIG. 6. FIG. 9 is a sectional view taken along arrow C-C indicated in FIG. 6. FIG. 10 is an exploded perspective view of the liquid header of the outdoor heat exchanger.

As shown in FIG. 7, the liquid header 21 has a rectangular shape in a bottom view and a top view. The liquid header 21 includes a first attachment member 41 to which the heat transfer tube 26 is attached, a flow path formation member 42 that forms a flow path of the refrigerant, and a second attachment member 43 to which the connection tube 35 is attached.

The first attachment member 41 includes a first attachment plate 51 and a second attachment plate 52. The flow path formation member 42 includes a first flow path formation plate (first plate) 61, a second flow path formation plate (second plate) 62, and a third flow path formation plate (third plate) 63. The second attachment member 43 includes a third attachment plate 53. The liquid header 21 is configured by overlapping the first attachment plate 51, the second attachment plate 52, the third flow path formation plate 63, the second flow path formation plate 62, the first flow path formation plate 61, and the third attachment plate 53 in that order. All of these plates include aluminum or aluminum alloy.

(First Attachment Plate)

Figure 11:
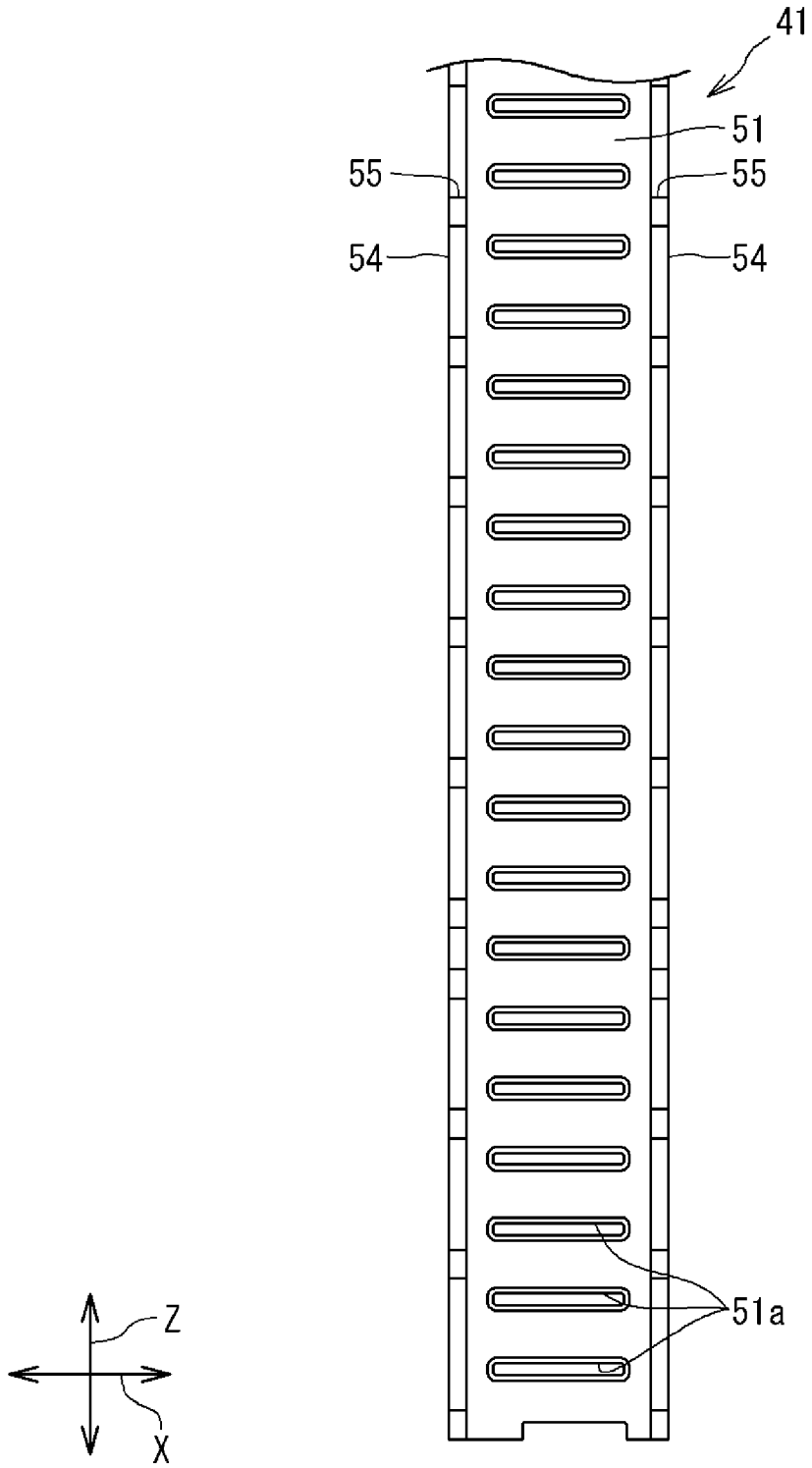
FIG. 11 is a front view of a first attachment plate according to one or more embodiments of the present disclosure.

FIG. 11 is a front view of the first attachment plate.

As shown in FIG. 10 and FIG. 11, the first attachment plate 51 is a rectangular plate member elongated in the up-down direction Z. The first attachment plate 51 is disposed in the left-right direction X. The first attachment plate 51 is provided with a plurality of first through holes 51*a* penetrating in the front-rear direction Y. The plurality of first through holes 51*a* are aligned in the up-down direction Z. Each of the first through holes 51*a* is a hole elongated in the left-right direction X. As shown in FIG. 8 and FIG. 9, one end of the heat transfer tube 26 is inserted into the first through hole 51*a*. An inner peripheral part of the first through hole 51*a* and an outer peripheral surface of the heat transfer tube 26 are joined by brazing.

As shown in FIG. 7 and FIG. 9, a pair of side plates 54 extending to the front (toward the connection tube 35) is provided on both sides of the first attachment plate 51 in the left-right direction X. The first attachment plate 51 and the pair of side plates 54 are formed by bending one plate material. The pair of side plates 54 sandwich the other plates 52, 63, 62, 61, and 53 overlapping the first attachment plate 51 from outside in the left-right direction X, and sets positions of the other plates 52, 63, 62, 61, and 53 in the left-right direction X. Therefore, the pair of side plates 54 appropriately set relative positions in the left-right direction X of the first attachment plate 51, the second attachment plate 52, the third attachment plate 53, the first flow path formation plate 61, the second flow path formation plate 62, and the third flow path formation plate 63.

A plurality of protrusions 55 are provided at a front edge (close to the connection tube 35) of the side plates 54. The protrusions 55 protrude from the side plates 54 in a direction in which the pair of side plates 54 face each other (inward in the left-right direction X). The protrusions 55 are in contact with a front surface of the third attachment plate 53 disposed between the pair of side plates 54, and press the third attachment plate 53 from the front. The protrusions 55 prevent the third attachment plate 53, the first to third flow path formation plates 61 to 63, and the second attachment plate 52 from being detached forward from between the pair of side plates 54.

As shown in FIG. 10, the protrusions 55 are not bent with respect to the side plates 54 and extend forward along the side plates 54 in a state before the first attachment plate 51, the second attachment plate 52, the third flow path formation plate 63, the second flow path formation plate 62, the first flow path formation plate 61, and the third attachment plate 53 constituting the liquid header 21 are overlapped with each other. Then, after the first attachment plate 51, the second attachment plate 52, the third flow path formation plate 63, the second flow path formation plate 62, the first flow path formation plate 61, and the third attachment plate 53 are overlapped with each other, the protrusions 55 are bent inward in the left-right direction X to be in contact with the front surface of the third attachment plate 53.

(Second Attachment Plate)

Figure 12:
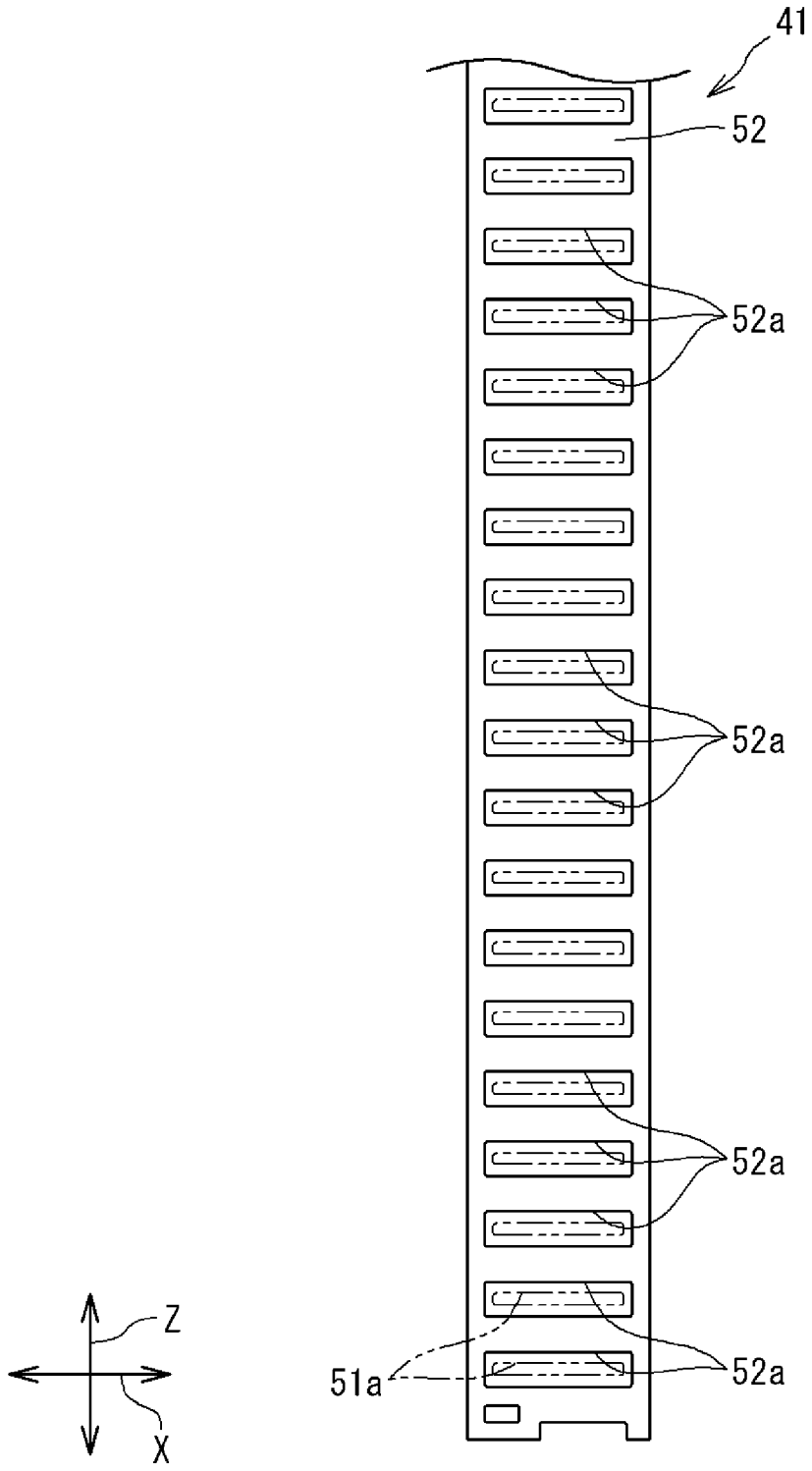
FIG. 12 is a front view of a second attachment plate according to one or more embodiments of the present disclosure.

FIG. 12 is a front view of the second attachment plate.

As shown in FIG. 10 and FIG. 12, the second attachment plate 52 is a rectangular plate member elongated in the up-down direction Z. The second attachment plate 52 has a length in the up-down direction Z and a length in the left-right direction X which are the same as a length in the up-down direction Z and a length in the left-right direction X of the first attachment plate 51, respectively. The second attachment plate 52 is disposed along the left-right direction X. The second attachment plate 52 is provided with a plurality of second through holes 52*a* penetrating in the front-rear direction Y. The plurality of second through holes 52*a* are aligned in the up-down direction Z. Each of the second through holes 52*a* is a hole elongated in the left-right direction X. The second through hole 52*a* has a length in the left-right direction X and a length in the up-down direction Z which are larger than a length of the first through hole 51*a* in the left-right direction X and a length of the first through hole 51*a* in the up-down direction Z, respectively. The plurality of second through holes 52*a* are provided at the same pitch as the plurality of first through holes 51*a*. When the first attachment plate 51 and the second attachment plate 52 are overlapped with each other, the plurality of first through holes 51*a* and the plurality of second through holes 52*a* are disposed to overlap each other and communicate with each other.

As shown in FIG. 8 and FIG. 9, an end of the heat transfer tube 26 inserted into the first through hole 51*a* is inserted into the second through hole 52*a*. A gap is formed between an inner peripheral surface of the second through hole 52*a* and the outer peripheral surface of the heat transfer tube 26.

(Third Flow Path Formation Plate)

Figure 13:
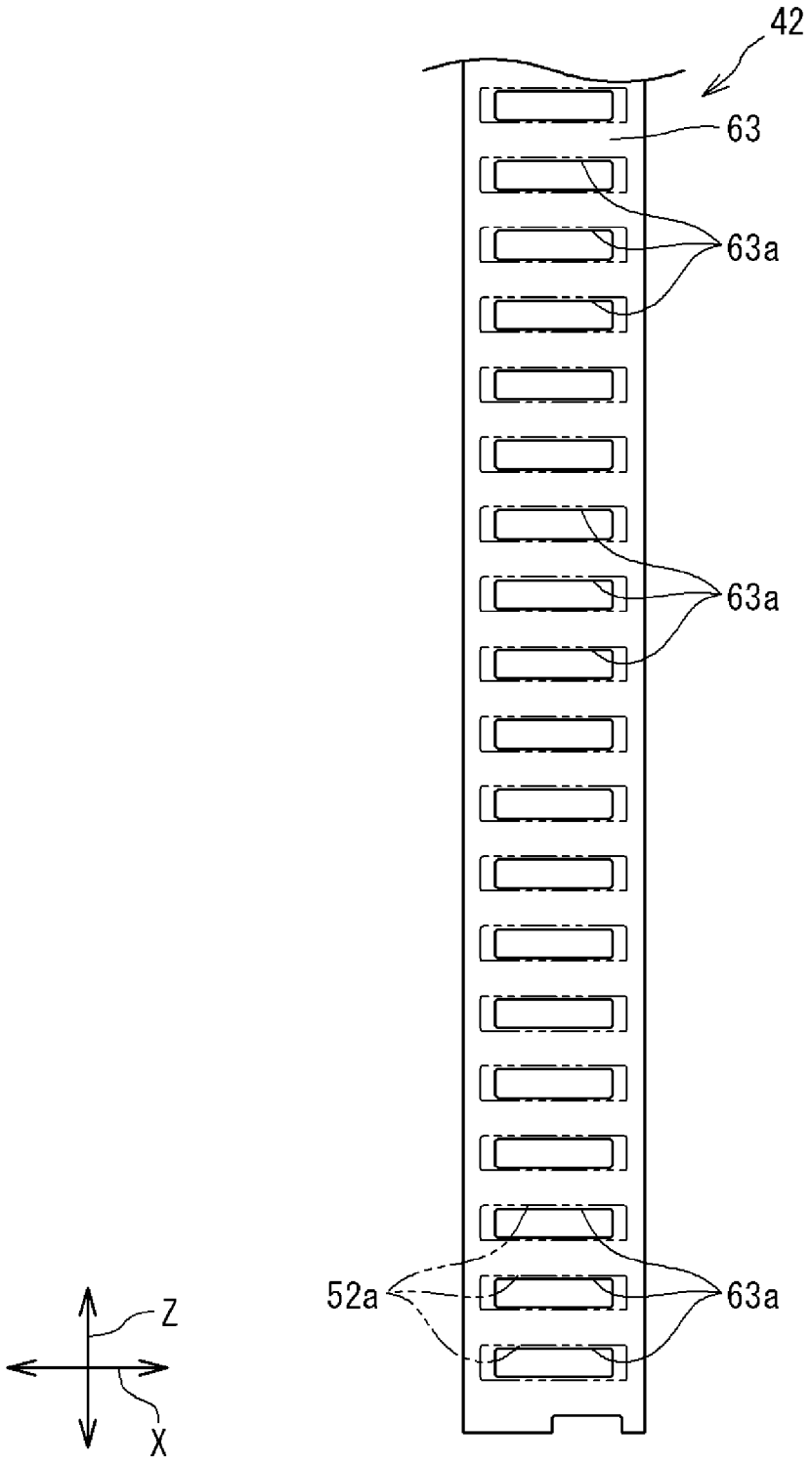
FIG. 13 is a front view of a third flow path formation plate according to one or more embodiments of the present disclosure.

FIG. 13 is a front view of the third flow path formation plate.

As shown in FIG. 10 and FIG. 13, the third flow path formation plate 63 is a rectangular plate member elongated in the up-down direction Z. The third flow path formation plate 63 has a length in the up-down direction Z and a length in the left-right direction X which are the same as the length in the up-down direction Z and the length in the left-right direction X of the second attachment plate 52, respectively. The third flow path formation plate 63 is disposed along the left-right direction X. The third flow path formation plate 63 is provided with a plurality of openings 63*a* penetrating in the front-rear direction Y. The plurality of openings 63*a* are aligned in the up-down direction Z. Each of the openings 63*a* is a hole elongated in the left-right direction X. A length of the opening 63*a* in the left-right direction X is smaller than the length of the first through hole 51*a* in the left-right direction X. The length of the opening 63*a* in the up-down direction Z is larger than a length of the first through hole 51*a* in the up-down direction Z. In one or more embodiments, the opening 63*a* of the third flow path formation plate 63 is also referred to as a "sixth opening".

The plurality of openings 63*a* of the third flow path formation plate 63 are provided at the same pitch as the plurality of second through holes 52*a*. When the second attachment plate 52 and the third flow path formation plate 63 are overlapped with each other, the plurality of second through holes 52*a* and the plurality of openings 63*a* are disposed to overlap each other. The heat transfer tube 26 inserted into the first through hole 51*a* and the second through hole 52*a* have both ends in the left-right direction X that are in contact with a rear surface of the third flow path formation plate 63 outside the opening 63*a* in the left-right direction. As a result, an amount of insertion of the heat transfer tube 26 into the first attachment plate 51 and the second attachment plate 52 is set. The opening 63*a* of the third flow path formation plate 63 communicates with the holes 26*p* provided in the heat transfer tube 26. The opening 63*a* of the third flow path formation plate 63 constitutes a part of the first to sixth flow paths 33A to 33F described above.

(Second Flow Path Formation Plate)

Figure 14:
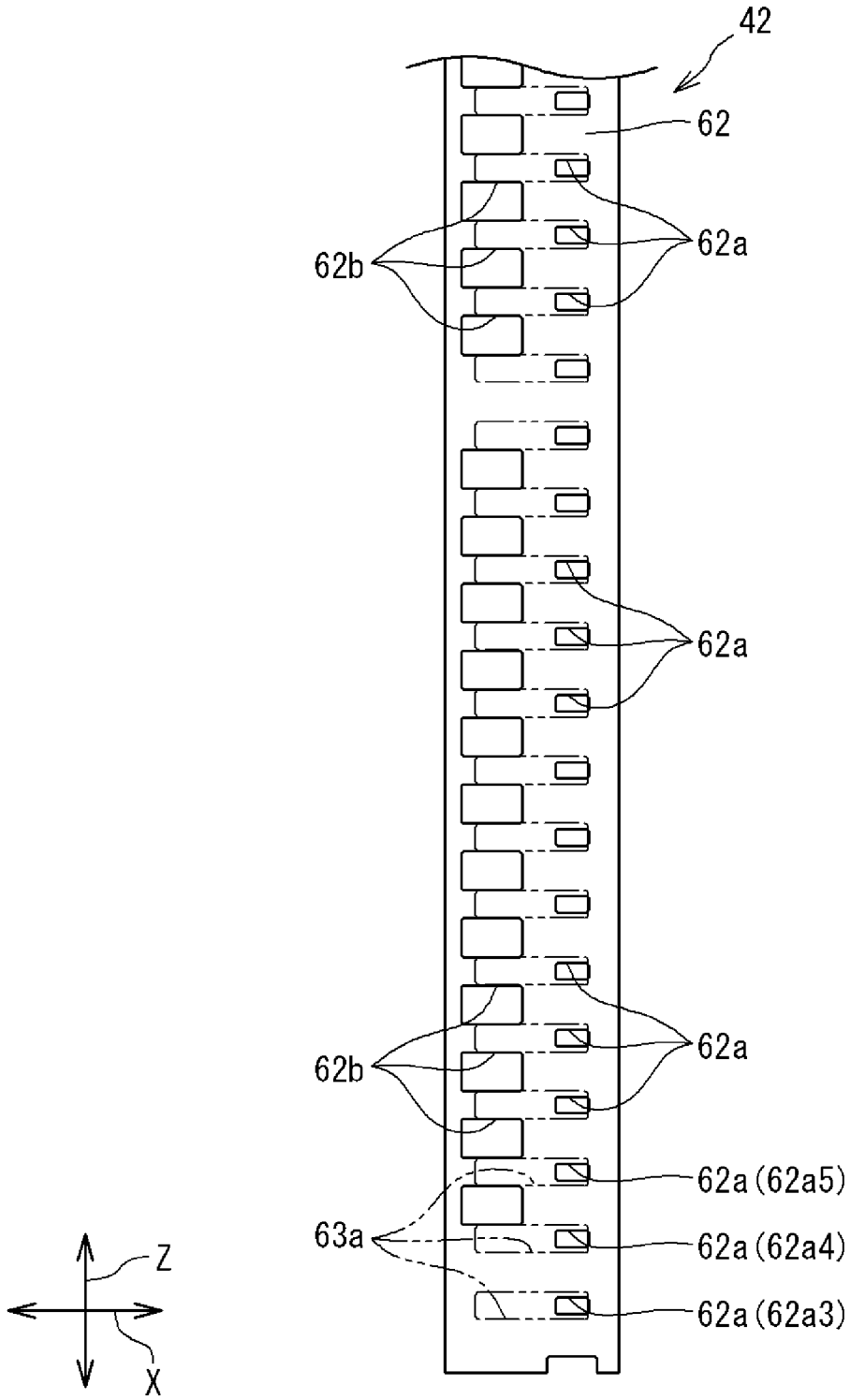
FIG. 14 is a front view of a second flow path formation plate according to one or more embodiments of the present disclosure.

FIG. 14 is a front view of the second flow path formation plate.

As shown in FIG. 10 and FIG. 14, the second flow path formation plate 62 is a rectangular plate member elongated in the up-down direction Z. The second flow path formation plate 62 has a length in the up-down direction Z and a length in the left-right direction X which are the same as the length in the up-down direction Z and the length in the left-right direction X of the third flow path formation plate 63, respectively. The second flow path formation plate 62 is disposed along the left-right direction X. The second flow path formation plate 62 is provided with a plurality of openings 62*a* penetrating in the front-rear direction Y. The plurality of openings 62*a* are aligned in the up-down direction Z. The opening 62*a* of the second flow path formation plate 62 has a length in the left-right direction X and a length in the up-down direction Z which are smaller than the length in the left-right direction X and the length in the up-down direction Z of the opening 63*a* of the third flow path formation plate 63, respectively.

The opening 62*a* of the second flow path formation plate 62 is disposed at a position biased to one side in the left-right direction X of the second flow path formation plate 62. Specifically, the opening 62*a* of the second flow path formation plate 62 is disposed at a position biased toward upstream in the airflow direction a in the heat exchanger body 23. The plurality of openings 62*a* of the second flow path formation plate 62 are provided at the same pitch as the plurality of openings 63*a* of the third flow path formation plate 63.

When the second flow path formation plate 62 and the third flow path formation plate 63 are overlapped with each other, both of the openings 62*a* and 63*a* are disposed to overlap each other and communicate with each other. Similar to the opening 63*a* of the third flow path formation plate 63, the opening 62*a* of the second flow path formation plate 62 constitutes a part of the first to sixth flow paths 33A to 33F described above.

In one or more embodiments, among the openings 62*a* of the second flow path formation plate 62, an opening 62*a*3 at a lowermost position may be referred to as a "third opening", an opening 62*a*4 adjacent the third opening 62*a*3 may be referred to as a "fourth opening", and an opening 62*a*5 adjacent the fourth opening 62*a*4 may be referred to as a "fifth opening".

In the second flow path formation plate 62, a plurality of connection openings 62*b* are provided at intervals in the up-down direction Z. The connection openings 62*b* connect a divided part of a second opening 61*b* of the first flow path formation plate 61 to be described later, and forms the second to sixth flow paths 33B to 33F together with the second opening 61*b*. The connection opening 62*b* is disposed at a position deviated to a side opposite to the opening 62*a* (downstream in the airflow direction a) in the left-right direction X. The connection opening 62*b* is disposed at a position corresponding to a position between the plurality of openings 62*a* in the up-down direction Z. The connection opening 62*b* has a length in the left-right direction X and a length in the up-down direction Z which are larger than a length of the opening 62*a* in the left-right direction X and a length in the up-down direction Z, respectively. Not all of the plurality of connection openings 62*b* are used, but only those positioned in the divided part of the second opening 61*b* of the first flow path formation plate 61 described later are used.

(First Flow Path Formation Plate)

Figure 15:
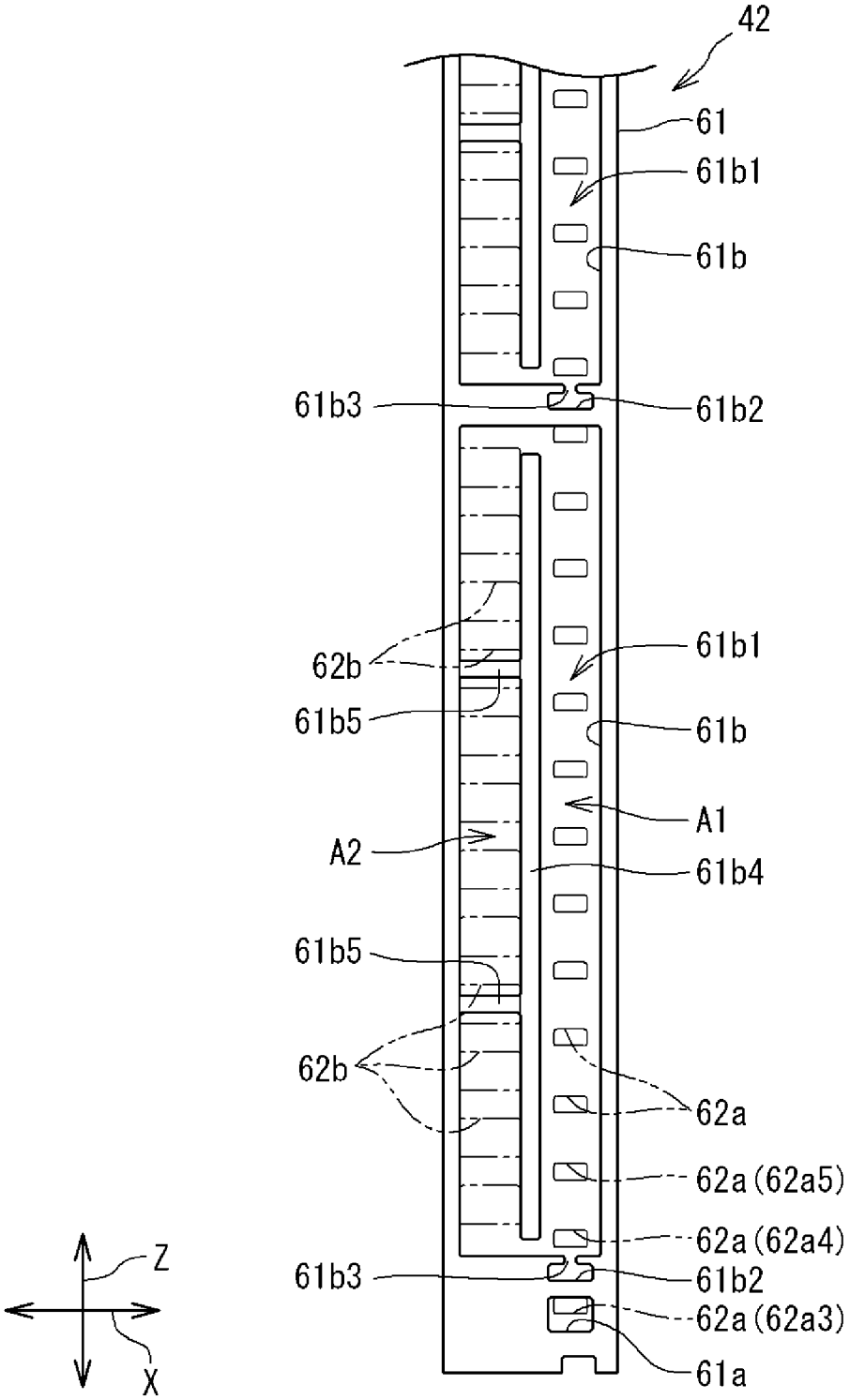
FIG. 15 is a front view of a first flow path formation plate according to one or more embodiments of the present disclosure.

FIG. 15 is a front view of the first flow path formation plate.

As shown in FIG. 10 and FIG. 15, the first flow path formation plate 61 is a rectangular plate member elongated in the up-down direction Z. The first flow path formation plate 61 has a length in the up-down direction Z and a length in the left-right direction X which are the same as the length in the up-down direction Z and the length in the left-right direction X of the second flow path formation plate 62, respectively. The first flow path formation plate 61 is disposed along the left-right direction X. The first flow path formation plate 61 is provided with a plurality of openings 61*a* and 61*b* penetrating in the front-rear direction Y. The plurality of openings 61*a* and 61*b* are aligned in the up-down direction Z. The openings 61*a* and 61*b* of the first flow path formation plate 61 have a first opening 61*a* disposed at a lowermost position and a plurality of second openings 61*b* aligned above the first opening 61*a*.

The first opening 61*a* is provided corresponding to the first heat exchange unit 31A in FIG. 3. The first opening 61*a* of the first flow path formation plate 61 is disposed at a position biased to one side in the left-right direction X (toward upstream in the airflow direction a) of the first flow path formation plate 61. The first opening 61*a* has a length in the left-right direction X and a length in the up-down direction Z which are larger than the length in the left-right direction X and the length in the up-down direction Z of the opening 62*a* of the second flow path formation plate 62, respectively.

As shown in FIG. 8, when the first flow path formation plate 61 and the second flow path formation plate 62 are overlapped with each other, the first opening 61*a* of the first flow path formation plate 61 and the lowermost opening (third opening) 62*a*3 of the second flow path formation plate 62 are disposed to overlap each other and communicate with each other. The first opening 61*a* of the first flow path formation plate 61 constitutes the first flow path 33A together with the third opening 62*a*3 of the second flow path formation plate 62 and the sixth opening 63*a* of the third flow path formation plate 63.

The plurality of second openings 61*b* of the first flow path formation plate 61 are provided corresponding to the second to sixth heat exchange units 31B to 31F in FIG. 3. Each of the second openings 61*b* has a circulation part 61*b*1, an entrance 61*b*2, and a connection part 61*b*3.

The circulation part 61*b*1 has a length in the left-right direction X and a length in the up-down direction Z which are larger than the length in the left-right direction X and the length in the up-down direction Z of the opening 62*a* of the second flow path formation plate 62, respectively. The circulation part 61*b*1 has a length in the up-down direction Z over the plurality of openings 62*a* of the second flow path formation plate 62. The circulation part 61*b*1 of each of the second openings 61*b* has a length in the up-down direction Z corresponding to each of the second to sixth heat exchange units 31B to 31F of the heat exchanger body 23.

When the first flow path formation plate 61 and the second flow path formation plate 62 are overlapped with each other, the circulation part 61*b*1 of the second opening 61*b* of the first flow path formation plate 61 and the plurality of openings 62*a* of the second flow path formation plate 62 are disposed to overlap each other and communicate with each other. In particular, as shown in FIG. 8, the second opening 61*b* of the first flow path formation plate 61 constitutes the second flow path 33B to be described later together with the fourth opening 62*a*4 of the second flow path formation plate 62 and the fifth opening 62*a*5 in the second flow path formation plate 62.

A partition member 61*b*4 is provided substantially at a center of the circulation part 61*b*1 in the left-right direction. The partition member 61*b*4 partitions the circulation part 61*b*1 into two regions A1 and A2 in the left-right direction X. A gap is formed between an upper end and a lower end of the partition member 61*b*4 and an upper end and a lower end of the circulation part 61*b*1, and the two regions A1 and A2 are connected at an upper end and a lower end. The refrigerant flowing into the circulation part 61*b*1 circulates around the partition member 61*b*4.

The partition member 61*b*4 is connected to one of left or right side of the circulation part 61*b*1 by two coupling members 61*b*5. Thus, one region A2 of the partition member 61*b*4 is divided in the up-down direction Z by the coupling member 61*b*5. The coupling member 61*b*5 is disposed at a position corresponding to a part of the connection opening 62*b* of the second flow path formation plate 62. A length of the coupling member 61*b*5 in the up-down direction Z is smaller than the length of the connection opening 62*b* in the up-down direction Z. When the first flow path formation plate 61 and the second flow path formation plate 62 are overlapped with each other, upper and lower parts of the region A2 as one of the regions of the circulation part 61*b*1 are connected by the connection opening 62*b* with the coupling member 61*b*5 interposed therebetween. Therefore, a flow of the refrigerant in the region A2 as one of the regions of the circulation part 61*b*1 is not hindered by the coupling member 61*b*5.

The entrance 61*b*2 of the second opening 61*b* of the first flow path formation plate 61 is disposed below the circulation part 61*b*1. The entrance 61*b*2 has a length in the left-right direction X and a length in the up-down direction Z which are smaller than the length in the left-right direction X and the length in the up-down direction Z of the circulation part 61*b*1, respectively. The entrance 61*b*2 is disposed at a position biased to one side in the left-right direction X (toward upstream in the airflow direction a) of the first flow path formation plate 61. When the first flow path formation plate 61 and the second flow path formation plate 62 are overlapped with each other, the entrance 61*b*2 does not overlap the opening 62*a* of the second flow path formation plate 62.

The connection part 61*b*3 of the second opening 61*b* of the first flow path formation plate 61 is disposed between the entrance 61*b*2 and the circulation part 61*b*1 in the up-down direction Z. The connection part 61*b*3 allows the entrance 61*b*2 and the circulation part 61*b*1 to connect and communicate to each other. The entrance 61*b*2 serves as an entrance of the refrigerant to the circulation part 61*b*1. A length of the connection part 61*b*3 in the left-right direction X is smaller than the length of the entrance 61*b*2 in the left-right direction X.

(Third Attachment Plate)

Figure 16:
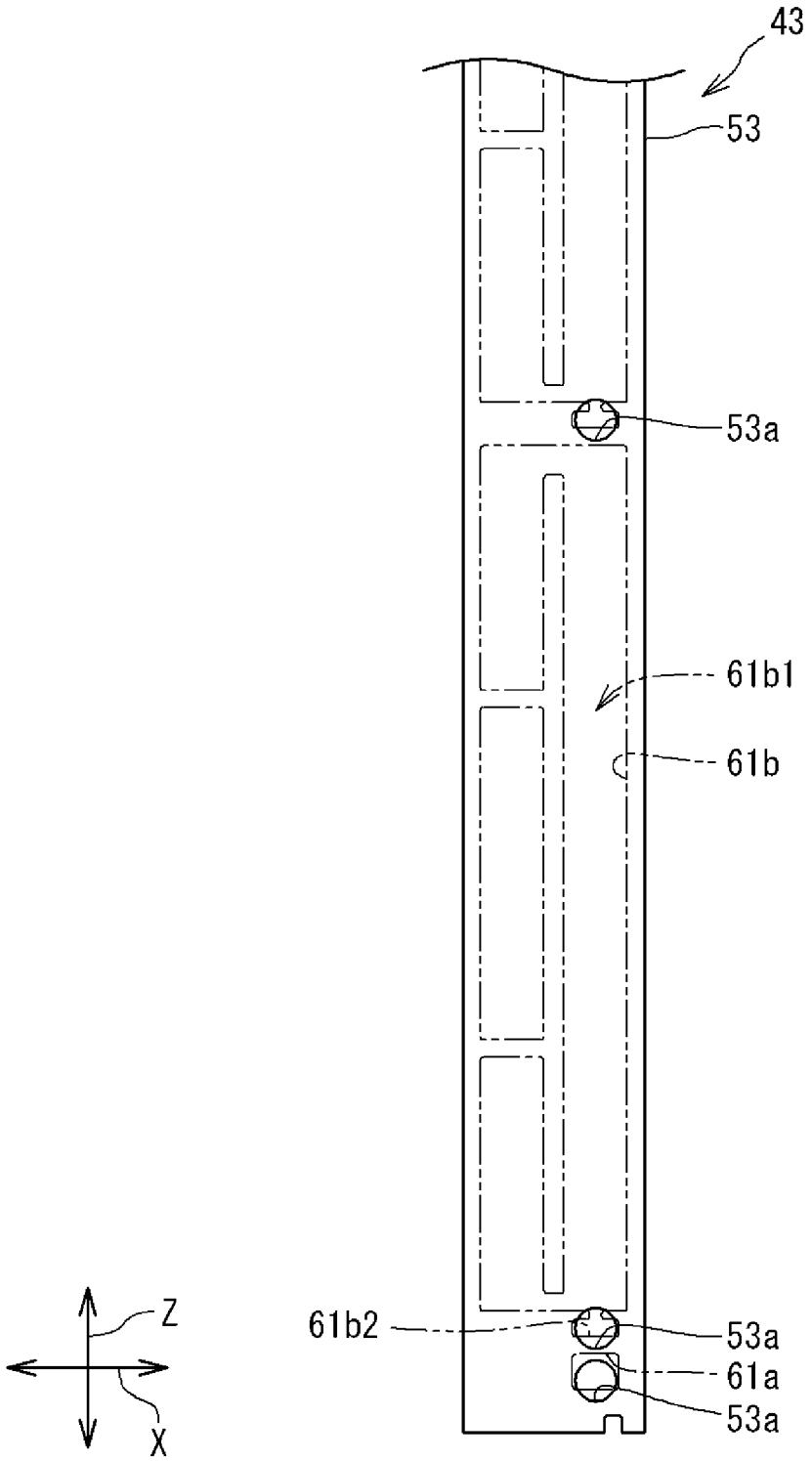
FIG. 16 is a front view of a third attachment plate according to one or more embodiments of the present disclosure.

FIG. 16 is a front view of the third attachment plate.

As shown in FIG. 10 and FIG. 16, the third attachment plate 53 is a rectangular plate member elongated in the up-down direction Z. The third attachment plate 53 has a length in the up-down direction Z and a length in the left-right direction X which are the same as the length in the up-down direction Z and the length in the left-right direction X of the first flow path formation plate 61, respectively. The third attachment plate 53 is disposed along the left-right direction X. The third attachment plate 53 is provided with a plurality of third through holes 53*a* penetrating in the front-rear direction Y. The plurality of third through holes 53*a* are aligned in the up-down direction Z. The third through hole 53*a* of the third attachment plate 53 is disposed at a position biased to one side in the left-right direction X (toward upstream in the airflow direction a) of the third attachment plate 53. The third through hole 53*a* at a lowermost position and the third through hole 53*a* at a second lowermost position are disposed close to each other. The third through hole 53*a* at the second lowermost position and the third through-hole 53*a* at a third lowermost position are disposed with a space therebetween corresponding to the length of the second heat exchange unit 31B in the up-down direction Z.

As shown in FIG. 8, the connection tube 35 is attached to each of the third through holes 53*a*. Specifically, an end of the connection tube 35 is inserted into each of the third through holes 53*a* and joined by brazing. When the third attachment plate 53 and the first flow path formation plate 61 are overlapped with each other, an end surface of the connection tube 35 is not in contact with a front surface of the first flow path formation plate 61. When the third attachment plate 53 and the first flow path formation plate 61 are overlapped with each other, the first connection tube 35A at the lowermost position and the first opening 61*a* of the first flow path formation plate 61 overlap and communicate with each other. The second connection tube 35B at the second lowermost position overlaps the entrance 61*b*2 at a lowermost position in the second opening 61*b* and communicates with the entrance 61*b*2. The third to sixth connection tubes 35C to 35F at third to sixth lowermost positions overlap the entrances 61*b*2 of the second openings 61*b* at the second to fifth lowermost positions and communicate with the entrances 61*b*2.

As described above, as shown in FIG. 8, the first flow path 33A of the liquid header 21 includes the first opening 61*a* of the first flow path formation plate 61, the third opening 62*a*3 of the second flow path formation plate 62, and the sixth opening 63*a* of the third flow path formation plate 63. One end of the first flow path 33A is connected to the first heat transfer tube 26*a* attached to the first and second attachment plates 51 and 52, and the other end of the first flow path 33A is connected to the first connection tube 35A attached to the third attachment plate 53.

The second flow path 33B of the liquid header 21 includes the second opening 61*b* of the first flow path formation plate 61, the fourth opening 62*a*4, the fifth opening 62*a*5, several openings 62*a* above the fifth opening 62*a*5 of the second flow path formation plate 62, and the sixth opening 63*a* of the third flow path formation plate 63. One end of the second flow path 33B is connected to the second and third heat transfer tubes 26*b* and 26*c* attached to the first and second attachment plates 51 and 52, and the other end of the second flow path 33B is connected to the second connection tube 35B attached to the third attachment plate 53.

The liquid refrigerant flowing from the second connection tube 35B to the liquid header 21 flows into the entrance 61*b*2 of the second opening 61*b* of the first flow path formation plate 61, passes through the connection part 61*b*3, and flows through the circulation part 61*b*1. The connection part 61*b*3, which has a smaller length in the left-right direction X than the entrance 61*b*2, functions as a nozzle that increases a flow velocity of the refrigerant flowing from the entrance 61*b*2 into the circulation part 61*b*1.

As shown in FIG. 3, in the liquid header 21, the third flow path 33C, the fourth flow path 33D, the fifth flow path 33E, and the sixth flow path 33F above the second flow path 33B are constituted by the second openings 61*b* at the second to fifth lowermost positions of the first flow path formation plate 61, the opening 62*a* of the second flow path formation plate 62, and the sixth opening 63*a* of the third flow path formation plate 63.

As shown in FIG. 10, the first connection tube 35A and the second connection tube 35B are attached to the third attachment plate 53 at positions close to each other in the up-down direction. The second connection tube 35B linearly extends forward from the third attachment plate 53 with a distal end directed forward. On the other hand, the first connection tube 35A extends forward from the third attachment plate 53 and then curves in the left-right direction X and the up-down direction Z with a distal end directed upward. Specifically, as shown in FIG. 6 and FIG. 10, the first connection tube 35A extends forward from the third attachment plate 53 substantially parallel to the second connection tube 35B, obliquely extends while changing the direction upward and to the other side in the left-right direction X (toward downstream in the airflow direction a) before reaching the distal end of the second connection tube 35B, and further extends while changing the direction upward. Therefore, the distal end of the first connection tube 35A and the distal ends of the second connection tube 35B and the third connection tube 35C are shifted in position in the left-right direction X.

[Operation and Effects]

In the air conditioner disclosed in Patent Literature 1, frost may adhere to the outdoor heat exchanger having a temperature lower than a temperature of outside air during heating operation. Therefore, defrosting operation is performed by causing a gas refrigerant to flow through the outdoor heat exchanger periodically or as necessary. In the outdoor heat exchanger disclosed in Patent Literature 1, during defrosting operation, the gas refrigerant having flowed into the outlet chamber of the first header flows through the flat tube between the first header and the second header and the chambers provided in the first header and the second header, flows into the inlet chamber of the second header in a condensed state, and is discharged to outside of the outdoor heat exchanger. However, since a liquid refrigerant that has flowed into the inlet chamber of the second header accumulates in a lower part of the inlet chamber, the lower flat tube among the plurality of flat tubes connected to the inlet chamber of the second header makes it difficult for the liquid refrigerant to flow into the inlet chamber, and has a relatively lower flow rate than the other flat tubes. Therefore, the frost is melted at a lower speed in a lowermost part of the outdoor heat exchanger, and the defrosting operation takes a longer time. One or more embodiments of the present disclosure enhances defrosting capability in a lowermost part of a heat exchanger.

(1) As shown in FIG. 3, the outdoor heat exchanger 14 according to one or more embodiments includes the plurality of heat transfer tubes 26 aligned in the up-down direction Z, the liquid header 21 to which the ends of the plurality of heat transfer tubes 26 are connected, and the plurality of connection tubes 35 aligned in the up-down direction Z and connected to the liquid header 21. The heat transfer tubes 26 include the first heat transfer tube 26*a* disposed at the lowermost position and the second heat transfer tube 26*b* disposed above and adjacent to the first heat transfer tube 26*a*. The connection tubes 35 include the first connection tube 35A disposed at the lowermost position and the second connection tube 35B disposed above the first connection tube 35A. As illustrated in FIGS. 3 and 8, the liquid header 21 includes the first flow path 33A to which the first connection tube 35A and the first heat transfer tube 26*a* are connected, and the second flow path 33B to which the second connection tube 35B and the second heat transfer tube 26*b* are connected.

When the outdoor heat exchanger 14 is used as a condenser for defrosting operation, the liquid refrigerant flowing from the first heat transfer tube 26*a* into the liquid header 21 is discharged from the first connection tube 35A to outside of the outdoor heat exchanger 14 through the first flow path 33A, and the liquid refrigerant flowing from the second heat transfer tube 26*b* into the liquid header 21 is discharged from the second connection tube 35B to outside of the outdoor heat exchanger 14 through the second flow path 33B.

If the liquid refrigerant from the first heat transfer tube 26*a* and the liquid refrigerant from the second heat transfer tube 26*b* flow into the same flow path in the liquid header 21, the liquid refrigerant accumulates in a lower part of the flow path, and the pressure of the refrigerant discharged from the first heat transfer tube 26*a* to the flow path increases. Therefore, a refrigerant flow rate of the first heat transfer tube 26*a* becomes relatively smaller than a refrigerant flow rate of the second heat transfer tube 26*b*, and defrosting capability of the refrigerant flowing through the first heat transfer tube 26*a* decreases. In general, the outdoor heat exchanger 14 is placed on a bottom plate of a housing of the air conditioner 1, and the heat easily escapes to the bottom plate. Therefore, when the defrosting capability of the first heat transfer tube 26*a* disposed at a lowermost part of the outdoor heat exchanger 14 decreases, the defrosting takes a long time.

In one or more embodiments, the liquid refrigerant from the first heat transfer tube 26*a* and the liquid refrigerant from the second heat transfer tube 26*b* flow through different flow paths (the first flow path 33A and the second flow path 33B) in the liquid header 21, and are discharged from the first connection tube 35A and the second connection tube 35B, respectively. Therefore, the refrigerant flow rate in the first heat transfer tube 26*a* at the lowermost position can be sufficiently secured, and the defrosting capability in the lowermost part of the outdoor heat exchanger 14 can be enhanced.

During defrosting operation, the gas refrigerant flowing from the gas header 22 into the first heat transfer tube 26*a* passes only through the first heat transfer tube 26*a* and is discharged to the liquid header 21. Thus, a pressure loss of the refrigerant flowing through the first heat transfer tube 26*a* can be reduced to the same extent as the other heat transfer tubes 26, and the flow rate of the refrigerant flowing through the first heat transfer tube 26*a* can be sufficiently secured.

(2) In the above embodiments, the plurality of heat transfer tubes 26 include the third heat transfer tube 26*c* disposed above the second heat transfer tube 26*b*, and the third heat transfer tube 26*c* are connected to the second flow path 33B. Accordingly, when the outdoor heat exchanger 14 is used as an evaporator for heating operation, the liquid refrigerant is divided by the liquid header 21 above the first heat transfer tube 26*a*, and can flow to the second heat transfer tube 26*b* and the third heat transfer tube 26*c*.

(3) In the above embodiments, as shown in FIG. 8, the liquid header 21 includes the first flow path formation plate (first plate) 61 and the second flow path formation plate (second plate) 62 that is overlapped with the first flow path formation plate 61 in the direction in which the first heat transfer tube 26*a* and the first connection tube 35A are aligned (front-rear direction Y) and that is disposed closer to the first heat transfer tube 26*a* than the first flow path formation plate 61. The first flow path formation plate 61 is provided with the first opening 61*a* disposed in a range where the first heat transfer tube 26*a* is provided in the up-down direction Z and the second opening 61*b* disposed over a range where the second heat transfer tube 26*b* and the third heat transfer tube 26*c* are provided in the up-down direction Z. The second flow path formation plate 62 is provided with the third opening 62*a*3 provided between the first opening 61*a* and the first heat transfer tube 26*a*, the fourth opening 62*a*4 provided between the second opening 61*b* and the second heat transfer tube 26*b*, and the fifth opening 62*a*5 provided between the second opening 61*b* and the third heat transfer tube 26*c*. The first flow path 33A is formed by the first opening 61*a* and the third opening 62*a*3. Therefore, the liquid header 21 is formed by a plurality of plates, and the first flow path 33A can be formed by the first opening 61*a* and the third opening 62*a*3 formed in each plate.

(4) In the above embodiments, as shown in FIG. 10 and FIG. 14, the third opening 62*a*3, the fourth opening 62*a*4, and the fifth opening 62*a*5 formed in the second flow path formation plate 62 are aligned in the up-down direction Z and have the same shape. Therefore, the openings 62*a* having the same shape can be used for both the first flow path 33A and the second flow path 33B, and the second flow path formation plate 62 having these openings 62*a* can be easily processed.

(5) In the above embodiments, as shown in FIG. 10 and FIG. 13, the liquid header 21 includes the third flow path formation plate (third plate) 63 disposed closer to the first heat transfer tube 26*a* than the second flow path formation plate 62. In the third flow path formation plate 63, a plurality of sixth openings 63*a* having the same shape and communicating with the plurality of heat transfer tubes 26 are aligned in the up-down direction Z. As shown in FIG. 8, the sixth openings 63*a* disposed at a lowermost position is disposed at a position overlapping the first opening 61*a* and the third opening 62*a*3, and constitutes a part of the first flow path 33A. In this configuration, one of the plurality of sixth openings 63*a* having the same shape formed in the third flow path formation plate 63 can be used to form the first flow path 33A. The plurality of sixth openings 63*a*, which have the same shape, facilitates processing for forming the sixth openings 63*a* in the third flow path formation plate 63.

(6) In the above embodiments, as shown in FIG. 10, the first connection tube 35A and the second connection tube 35B are disposed adjacent to each other, and the first connection tube 35A has a shape curved in a direction different from an extending direction of the second connection tube 35B. Therefore, even though one end of the first connection tube 35A and one end of the second connection tube 35B close to the liquid header 21 are close to each other, the other ends of the connection tubes 35 can be disposed apart from each other. Therefore, the capillary tubes 37A and 37B can be easily connected to the other ends of the connection tubes 35.

(7) In the flow divider 19, the capillary tube 37A connected to the first connection tube 35A has a larger flow resistance than the other capillary tubes 37B to 37F. Therefore, during heating operation, the flow rate of the refrigerant flowing through the first heat transfer tube 26*a* can be made relatively smaller than the flow rate of the refrigerant flowing through the other heat transfer tubes 26. As shown in FIG. 2, in the outdoor unit 2 according to one or more embodiments, the outdoor fan 18 is disposed above the outdoor heat exchanger 14. Thus, a volume of air passing through the outdoor heat exchanger 14 is larger and a heat exchange capability is higher in the upper part of the outdoor heat exchanger 14, but the volume of air is smaller and the heat exchange capability is lower near the first heat transfer tube 26*a* at the lowermost part of the outdoor heat exchanger 14. Therefore, even though the refrigerant flow rate of the first heat transfer tube 26*a* is increased, there is a possibility that heat exchange is not sufficiently performed. In one or more embodiments, by making the flow resistance of the capillary tube 37A connected to the first connection tube 35A larger than the flow resistance of the other capillary tubes 37B to 37F, the flow rate of the refrigerant flowing through the first heat transfer tube 26*a* can be reduced, and the refrigerant can flow at a flow rate corresponding to the heat exchange capacity of the first heat transfer tube 26*a*.

The present disclosure should not be limited to the above exemplification, but is intended to include any modification recited in claims within meanings and a scope equivalent to those of the claims.

The outdoor heat exchanger 14 according to the above embodiments has a substantially U shape in a top view, but may alternatively have a substantially L shape in a top view to face two side walls of the casing of the outdoor unit 2. The outdoor heat exchanger 14 may be formed so as to face the four side walls of the casing.

The number of the heat exchange units 31A to 31F in the outdoor heat exchanger 14 and the number of the heat transfer tubes 26 in the heat exchange units 31B to 31F other than the heat exchange unit 31A at a lowermost part are not limited to the above embodiments, and can be appropriately changed.

In the above embodiments, the liquid header 21 is configured by overlapping the plurality of plates 51, 52, 63, 62, 61, and 53, but may be configured by a simple circular tube or a square tube.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner
14 outdoor heat exchanger
21 liquid header
22 gas header
26 heat transfer tube
26*a* first heat transfer tube
26*b* second heat transfer tube
26*c* third heat transfer tube
26*p* hole (flow path)
33A first flow path
33B second flow path
35 connection tube
35A first connection tube
35B second connection tube
61 first flow path formation plate (first plate)
61*a* first opening
61*b* second opening
62 second flow path formation plate (second plate)
62*a*3 third opening
62*a*4 fourth opening
62*a*5 fifth opening
63 third flow path formation plate (third plate)
63*a* sixth opening

What is claimed is:

1. A heat exchanger comprising:

heat transfer tubes aligned in an up-down direction;

a liquid header connected to first ends in a length direction of the heat transfer tubes; and connection tubes aligned in the up-down direction and connected to the liquid header, wherein the heat transfer tubes include:

a first heat transfer tube disposed at a lowermost position in the up-down direction; and a second heat transfer tube disposed directly above the first heat transfer tube in the up-down direction, the connection tubes include:

a first connection tube disposed at a lowermost position in the up-down direction; and a second connection tube disposed above the first connection tube in the up-down direction, and the liquid header includes:

a first flow path connected to the first connection tube and the first heat transfer tube; and a second flow path connected to the second connection tube and the second heat transfer tube.

2. The heat exchanger according to claim 1, wherein the heat transfer tubes include a third heat transfer tube disposed above the second heat transfer tube in the up-down direction, and the third heat transfer tube is connected to the second flow path.

3. The heat exchanger according to claim 2, wherein the liquid header includes:

a first plate; and a second plate that is overlapped with the first plate in a direction in which the first heat transfer tube and the first connection tube are aligned, where the second plate is disposed closer to the first heat transfer tube than the first plate, the first plate includes:

a first opening disposed in a range where the first heat transfer tube is disposed along the up-down direction; and a second opening disposed over a range where the second heat transfer tube and the third heat transfer tube are disposed along the up-down direction, the second plate includes:

a third opening disposed between the first opening and the first heat transfer tube;

a fourth opening disposed between the second opening and the second heat transfer tube; and a fifth opening disposed between the second opening and the third heat transfer tube, and the first flow path is constituted by the first opening and the third opening.

4. The heat exchanger according to claim 3, wherein the third opening, the fourth opening, and the fifth opening disposed in the second plate are aligned in the up-down direction and have an identical shape.

5. The heat exchanger according to claim 3, wherein the liquid header includes a third plate disposed closer to the first heat transfer tube than the second plate, the third plate includes sixth openings that have an identical shape, that communicate with the heat transfer tubes, and that are aligned in the up-down direction, one of the sixth openings disposed at a lowermost position in the up-down direction overlaps the first opening and the third opening in the direction in which the first heat transfer tube and the first connection tube are aligned, and the sixth openings disposed at the lowermost position in the up-down direction constitutes a part of the first flow path.

6. The heat exchanger according to claim 1, wherein the first connection tube and the second connection tube are disposed adjacent to each other, and the first connection tube has a shape curved in a direction different from an extending direction of the second connection tube.

7. The heat exchanger according to claim 1, further comprising a gas header connected to second ends in the length direction of the heat transfer tubes.

8. The heat exchanger according to claim 1, wherein the heat transfer tubes are multi-hole tubes having a plurality of flow paths inside the heat transfer tubes.

* * * * *